US009682716B2

(12) United States Patent
Noffsinger et al.

(10) Patent No.: US 9,682,716 B2
(45) Date of Patent: Jun. 20, 2017

(54) ROUTE EXAMINING SYSTEM AND METHOD

(71) Applicant: General Electric Company, Schenectady, NY (US)

(72) Inventors: Joseph Forrest Noffsinger, Lee's Summit, MO (US); Jeffrey Michael Fries, Lee's Summit, MO (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 14/679,217

(22) Filed: Apr. 6, 2015

(65) Prior Publication Data

US 2015/0210304 A1 Jul. 30, 2015

Related U.S. Application Data

(63) Continuation-in-part of application No. 14/527,246, filed on Oct. 29, 2014, which is a continuation-in-part (Continued)

(51) Int. Cl.

| | |
|---|---|
| ***B61L 1/18*** | (2006.01) |
| ***B61L 23/04*** | (2006.01) |
| ***B61L 3/10*** | (2006.01) |

(52) U.S. Cl.

CPC ..... *B61L 23/044* (2013.01); *B61L 3/10* (2013.01)

(58) Field of Classification Search

None

See application file for complete search history.

(56) References Cited

U.S. PATENT DOCUMENTS

| | | | |
|---|---|---|---|
| 2,104,601 | A | 1/1938 | Young |
| 2,104,652 | A | 1/1938 | Inman |

(Continued)

FOREIGN PATENT DOCUMENTS

| | | | |
|---|---|---|---|
| CN | 102556118 | B | 6/2014 |
| DE | 19826764 | A1 | 12/1999 |

(Continued)

OTHER PUBLICATIONS

Brawner, J.; Mueller, K. T.; "Magnetometer Sensor Feasibility for Railroad and Highway Equipment Detection", Innovations Deserving Exploratory Analysis Programs, HSR IDEA Program Final Report; Jun. 24, 2006; pp. 1-27.

(Continued)

*Primary Examiner* — Truc M Do
*Assistant Examiner* — Jess Whittington
(74) *Attorney, Agent, or Firm* — Global Patent Operation; John A. Kramer

(57) ABSTRACT

A system includes first and second application devices, a control unit, and at least one processor. The first and second application devices are configured to be at least one of conductively or inductively coupled with one of the conductive tracks. The control unit is configured to control the first and second application devices in order to electrically inject a first examination signal into the conductive tracks via the first application device and a second examination signal into the conductive tracks via the second application device. The at least one processor is configured to monitor one or more electrical characteristics of the first and second conductive tracks in response to the first and second examination signals being injected into the conductive tracks; and to identify a type of fault based upon the one or more electrical characteristics of the first and second conductive tracks.

18 Claims, 11 Drawing Sheets

Related U.S. Application Data of application No. 14/016,310, filed on Sep. 3, 2013, now Pat. No. 8,914,171.

(60) Provisional application No. 61/985,103, filed on Apr. 28, 2014, provisional application No. 61/729,188, filed on Nov. 21, 2012.

(56) References Cited

U.S. PATENT DOCUMENTS

| | | | |
|---|---|---|---|
| 2,111,513 | A | 3/1938 | Phinney |
| 2,148,005 | A | 2/1939 | Allen et al. |
| 2,233,932 | A | 3/1941 | Allen |
| 2,289,857 | A | 7/1942 | Allen |
| 2,293,926 | A | 8/1942 | Wallace |
| 2,366,802 | A | 1/1945 | Pflasterer |
| 2,601,634 | A | 6/1952 | Rivette |
| 2,783,369 | A | 2/1957 | Weber |
| 2,925,552 | A | 2/1960 | Cowan et al. |
| 2,927,711 | A | 3/1960 | Naggiar |
| 3,246,141 | A | 4/1966 | Ehrlich |
| 3,508,496 | A | 4/1970 | Larson |
| 3,519,805 | A | 7/1970 | Throne-Booth |
| 3,537,401 | A | 11/1970 | Metzner |
| 3,575,596 | A | 4/1971 | Schatzel |
| 3,650,216 | A | 3/1972 | Harwick et al. |
| 3,655,962 | A | 4/1972 | Koch |
| 3,718,040 | A | 2/1973 | Freeman et al. |
| 3,781,139 | A | 12/1973 | Lohse |
| 3,791,473 | A | 2/1974 | Rosen |
| 3,794,833 | A | 2/1974 | Blazek et al. |
| 3,805,056 | A | 4/1974 | Birkin |
| 3,813,885 | A | 6/1974 | Tabor |
| 3,865,042 | A | 2/1975 | DePaola et al. |
| 3,886,870 | A | 6/1975 | Pelabon |
| 3,937,432 | A | 2/1976 | Birkin |
| 3,948,314 | A | 4/1976 | Creswick et al. |
| 4,003,019 | A | 1/1977 | Tronel |
| 4,005,838 | A | 2/1977 | Grundy |
| 4,041,283 | A | 8/1977 | Mosier |
| 4,042,810 | A | 8/1977 | Mosher |
| 4,062,419 | A | 12/1977 | Kadota |
| 4,075,632 | A | 2/1978 | Baldwin et al. |
| 4,100,795 | A | 7/1978 | Panetti |
| 4,136,432 | A | 1/1979 | Melley, Jr. |
| 4,159,088 | A | 6/1979 | Cosley |
| 1,181,278 | A | 1/1980 | Pascoe |
| 4,181,943 | A | 1/1980 | Mercer, Sr. et al. |
| 4,214,647 | A | 7/1980 | Lutts |
| 4,241,403 | A | 12/1980 | Schultz |
| 4,253,399 | A | 3/1981 | Spigarelli |
| 4,262,209 | A | 4/1981 | Berner |
| 4,279,395 | A | 7/1981 | Boggio et al. |
| 4,324,376 | A | 4/1982 | Kuhn |
| 4,344,364 | A | 8/1982 | Nickles et al. |
| 4,355,582 | A | 10/1982 | Germer |
| 4,360,873 | A | 11/1982 | Wilde et al. |
| 4,361,202 | A | 11/1982 | Minovitch |
| 4,401,035 | A | 8/1983 | Spigarelli et al. |
| 4,425,097 | A | 1/1984 | Owens |
| 4,524,745 | A | 6/1985 | Tominari et al. |
| 4,548,164 | A | 10/1985 | Ylonen et al. |
| 4,561,057 | A | 12/1985 | Haley, Jr. et al. |
| 4,565,548 | A | 1/1986 | Davis et al. |
| 4,582,280 | A | 4/1986 | Nichols et al. |
| 4,582,580 | A | 4/1986 | Goudal et al. |
| 4,602,335 | A | 7/1986 | Perlmutter |
| 4,644,705 | A | 2/1987 | Saccomani et al. |
| 4,663,713 | A | 5/1987 | Cornell et al. |
| 4,711,418 | A | 12/1987 | Aver, Jr. et al. |
| 4,718,351 | A | 1/1988 | Engle |
| 4,735,385 | A | 4/1988 | Nickles et al. |
| 4,773,590 | A | 9/1988 | Dash et al. |
| 4,794,548 | A | 12/1988 | Lynch et al. |
| 4,827,438 | A | 5/1989 | Nickles et al. |
| 4,843,575 | A | 6/1989 | Crane |
| 4,853,883 | A | 8/1989 | Nickles et al. |
| 4,932,614 | A | 6/1990 | Birkin |
| 4,944,474 | A | 7/1990 | Jones |
| 5,055,835 | A | 10/1991 | Sutton |
| 5,109,343 | A | 4/1992 | Budway |
| 5,129,605 | A | 7/1992 | Burns et al. |
| 5,133,645 | A | 7/1992 | Crowley et al. |
| 5,177,684 | A | 1/1993 | Harker et al. |
| 5,181,541 | A | 1/1993 | Bodenheimer |
| 5,187,945 | A | 2/1993 | Dixon |
| 5,197,438 | A | 3/1993 | Kumano et al. |
| 5,197,627 | A | 3/1993 | Disabato et al. |
| 5,201,294 | A | 4/1993 | Osuka |
| 5,230,613 | A | 7/1993 | Hilsbos et al. |
| 5,240,416 | A | 8/1993 | Bennington |
| 5,253,153 | A | 10/1993 | Mathews et al. |
| 5,261,366 | A | 11/1993 | Regueiro |
| 5,277,156 | A | 1/1994 | Osuka et al. |
| 5,313,924 | A | 5/1994 | Regueiro |
| 5,316,174 | A | 5/1994 | Schutz |
| 5,357,912 | A | 10/1994 | Barnes et al. |
| 5,363,787 | A | 11/1994 | Konopasek et al. |
| 5,365,902 | A | 11/1994 | Hsu |
| 5,388,034 | A | 2/1995 | Allen et al. |
| 5,394,851 | A | 3/1995 | Cryer et al. |
| 5,398,186 | A | 3/1995 | Nakhla |
| 5,398,894 | A | 3/1995 | Pascoe |
| 5,420,883 | A | 5/1995 | Swensen et al. |
| 5,433,182 | A | 7/1995 | Augustin et al. |
| 5,437,422 | A | 8/1995 | Newman |
| 5,441,027 | A | 8/1995 | Buchanon et al. |
| 5,459,666 | A | 10/1995 | Casper et al. |
| 5,460,013 | A | 10/1995 | Thomsen |
| 5,462,244 | A | 10/1995 | Van Der Hoek et al. |
| 5,487,002 | A | 1/1996 | Diller et al. |
| 5,487,516 | A | 1/1996 | Murata et al. |
| 5,492,099 | A | 2/1996 | Maddock |
| 5,533,695 | A | 7/1996 | Heggestad et al. |
| 5,565,874 | A | 10/1996 | Rode |
| 5,570,284 | A | 10/1996 | Roselli et al. |
| 5,574,649 | A | 11/1996 | Levy |
| 5,574,659 | A | 11/1996 | Delvers et al. |
| 5,583,769 | A | 12/1996 | Saitoh |
| 5,588,716 | A | 12/1996 | Stumpe |
| 5,600,558 | A | 2/1997 | Mearek et al. |
| 5,605,134 | A | 2/1997 | Martin |
| 5,618,179 | A | 4/1997 | Copperman et al. |
| 5,642,827 | A | 7/1997 | Madsen |
| 5,651,330 | A | 7/1997 | Jewett |
| RE35,590 | E | 8/1997 | Bezos et al. |
| 5,676,059 | A | 10/1997 | Alt |
| 5,681,015 | A | 10/1997 | Kull |
| 5,699,986 | A | 12/1997 | Welk |
| 5,713,540 | A | 2/1998 | Gerszberg et al. |
| 5,720,455 | A | 2/1998 | Kull et al. |
| 5,735,492 | A | 4/1998 | Pace |
| 5,738,311 | A | 4/1998 | Fernandez |
| 5,740,547 | A | 4/1998 | Kull et al. |
| 5,755,349 | A | 5/1998 | Brundle |
| 5,758,299 | A | 5/1998 | Sandborg et al. |
| 5,775,228 | A | 7/1998 | Lamba et al. |
| 5,785,392 | A | 7/1998 | Hart |
| 5,803,411 | A | 9/1998 | Ackerman et al. |
| 5,813,635 | A | 9/1998 | Fernandez |
| 5,817,934 | A | 10/1998 | Skantar |
| 5,820,226 | A | 10/1998 | Hart |
| 5,828,979 | A | 10/1998 | Polivka et al. |
| 5,832,895 | A | 11/1998 | Takahashi et al. |
| 5,833,325 | A | 11/1998 | Hart |
| 5,836,529 | A | 11/1998 | Gibbs |
| 5,856,802 | A | 1/1999 | Ura et al. |
| 5,913,170 | A | 6/1999 | Wortham |
| 5,927,822 | A | 7/1999 | Hart |
| 5,928,294 | A | 7/1999 | Zelinkovsky |
| 5,934,764 | A | 8/1999 | Dimsa et al. |
| 5,936,517 | A | 8/1999 | Yeh |
| 5,944,392 | A | 8/1999 | Tachihata et al. |
| 5,950,966 | A | 9/1999 | Hungate et al. |

(56) References Cited

U.S. PATENT DOCUMENTS 5,950,967 A 9/1999 Montgomery
5,957,571 A 9/1999 Koster et al.
5,969,643 A 10/1999 Curtis
5,978,718 A 11/1999 Kull
5,983,144 A 11/1999 Bonissone et al.
5,986,577 A 11/1999 Bezos
5,986,579 A 11/1999 Halvorson
6,195,020 B1 2/2001 Brodeur, Sr. et al.
6,533,223 B1 3/2003 Ireland
7,188,009 B2 3/2007 Hawthorne
8,160,832 B2 4/2012 Luo et al.
8,264,330 B2 9/2012 Yeldell et al.
8,305,567 B2 11/2012 Hesser et al.
8,682,514 B2 3/2014 Falk et al.
8,888,052 B2 11/2014 Baldwin et al.
2001/0001131 A1 5/2001 Miller
2001/0019263 A1* 9/2001 Kwun ..... G01N 29/11 324/217
2001/0026321 A1 10/2001 Goto
2001/0047241 A1 11/2001 Khavakh et al.
2002/0010531 A1 1/2002 Hawthorne et al.
2002/0059075 A1 5/2002 Schick et al.
2002/0062819 A1 5/2002 Takahashi
2002/0065610 A1* 5/2002 Clark ..... B61D 15/00 702/35
2002/0065629 A1* 5/2002 Clark ..... B61D 15/00 702/182
2002/0065698 A1 5/2002 Schick et al.
2002/0072833 A1 6/2002 Gray
2002/0096081 A1 7/2002 Kraft
2002/0103585 A1 8/2002 Biess et al.
2002/0104779 A1 8/2002 Connor et al.
2002/0107618 A1 8/2002 Deguchi et al.
2002/0157901 A1 10/2002 Kast et al.
2002/0174653 A1 11/2002 Uzkan
2002/0188397 A1 12/2002 Biess et al.
2002/0195086 A1 12/2002 Beck et al.
2003/0000499 A1 1/2003 Doelker et al.
2003/0034423 A1 2/2003 Hess, Jr. et al.
2003/0055666 A1 3/2003 Roddy et al.
2003/0060968 A1 3/2003 MacPhail et al.
2003/0076221 A1 4/2003 Akiyama et al.
2003/0091017 A1 5/2003 Davenport et al.
2003/0104899 A1 6/2003 Keller
2003/0105561 A1 6/2003 Nickles et al.
2003/0107548 A1 6/2003 Eun et al.
2003/0120400 A1 6/2003 Ahmed Baig et al.
2003/0139909 A1 7/2003 Ozawa
2003/0158640 A1 8/2003 Pillar et al.
2003/0183729 A1 10/2003 Root et al.
2003/0187694 A1 10/2003 Rowen
2003/0213875 A1 11/2003 Hess, Jr. et al.
2003/0214417 A1 11/2003 Peltz et al.
2003/0222981 A1 12/2003 Kisak et al.
2003/0229097 A1 12/2003 Watkins et al.
2003/0229446 A1 12/2003 Boscamp et al.
2003/0233959 A1 12/2003 Kumar
2003/0236598 A1 12/2003 Villarreal Antelo et al.
2004/0010432 A1 1/2004 Matheson et al.
2004/0024515 A1 2/2004 Troupe et al.
2004/0024518 A1 2/2004 Boley et al.
2004/0025849 A1 2/2004 West et al.
2004/0026574 A1 2/2004 Seifert
2004/0034556 A1 2/2004 Matheson et al.
2004/0038831 A1 2/2004 Eadie
2004/0048620 A1 3/2004 Nakahara et al.
2004/0049339 A1 3/2004 Kober et al.
2004/0068359 A1 4/2004 Neiss et al.
2004/0073361 A1 4/2004 Tzamaloukas et al.
2004/0075280 A1 4/2004 Kumar et al.
2004/0098142 A1 5/2004 Warren et al.
2004/0107042 A1 6/2004 Seick
2004/0108814 A1 6/2004 Tsuda et al.
2004/0129289 A1 7/2004 Hafemann
2004/0129840 A1 7/2004 Horst
2004/0133315 A1 7/2004 Kumar et al.
2004/0143374 A1 7/2004 Horst et al.
2004/0153221 A1 8/2004 Kumar
2004/0167687 A1 8/2004 Kornick et al.
2004/0172175 A1 9/2004 Julich et al.
2004/0174121 A1 9/2004 Tsuda et al.
2004/0238693 A1 12/2004 Cole
2004/0243664 A1 12/2004 Horstemeyer
2004/0245410 A1 12/2004 Kisak et al.
2004/0249571 A1 12/2004 Blesener et al.
2005/0004723 A1 1/2005 Duggan et al.
2005/0007020 A1 1/2005 Tsuda et al.
2005/0045058 A1 3/2005 Donnelly et al.
2005/0055157 A1 3/2005 Scholl
2005/0055287 A1 3/2005 Schmidtberg et al.
2005/0065674 A1 3/2005 Houpt et al.
2005/0065711 A1 3/2005 Dahlgren et al.
2005/0076716 A1 4/2005 Turner
2005/0090978 A1 4/2005 Bathory et al.
2005/0096797 A1 5/2005 Matsubara et al.
2005/0099323 A1 5/2005 Hirose
2005/0107954 A1 5/2005 Nahla
2005/0109882 A1 5/2005 Armbruster et al.
2005/0120904 A1 6/2005 Kumar et al.
2005/0121005 A1 6/2005 Edwards
2005/0121971 A1 6/2005 Ring
2005/0171655 A1 8/2005 Flynn et al.
2005/0171657 A1 8/2005 Kumar
2005/0186325 A1 8/2005 Luangthep
2005/0188745 A1 9/2005 Staphanos et al.
2005/0189815 A1 9/2005 Bryant
2005/0189886 A1 9/2005 Donnelly et al.
2005/0192720 A1 9/2005 Christie et al.
2005/0196737 A1 9/2005 Mann
2005/0205719 A1 9/2005 Hendrickson et al.
2005/0210304 A1 9/2005 Hartung et al.
2005/0229604 A1 10/2005 Chen
2005/0251299 A1 11/2005 Donnelly et al.
2005/0253397 A1 11/2005 Kumar et al.
2005/0285552 A1 12/2005 Grubba et al.
2005/0288832 A1 12/2005 Smith et al.
2006/0005736 A1 1/2006 Kumar
2006/0025903 A1 2/2006 Kumar
2006/0030978 A1 2/2006 Rajaram
2006/0047379 A1 3/2006 Schullian et al.
2006/0055175 A1 3/2006 Grinblat
2006/0060345 A1 3/2006 Flik et al.
2006/0085103 A1 4/2006 Smith et al.
2006/0085363 A1 4/2006 Cheng et al.
2006/0086546 A1 4/2006 Hu et al.
2006/0116789 A1 6/2006 Subramanian et al.
2006/0116795 A1 6/2006 Abe et al.
2006/0122737 A1 6/2006 Tani et al.
2006/0129289 A1 6/2006 Kumar et al.
2006/0138285 A1 6/2006 Oleski et al.
2006/0162973 A1 7/2006 Harris et al.
2006/0178800 A1 8/2006 Chen et al.
2006/0187086 A1 8/2006 Quintos
2006/0212188 A1 9/2006 Kickbusch et al.
2006/0212189 A1 9/2006 Kickbusch et al.
2006/0219214 A1 10/2006 Okude et al.
2006/0225710 A1 10/2006 Taglialatela-Scafati et al.
2006/0231066 A1 10/2006 Demura et al.
2006/0235584 A1 10/2006 Fregene et al.
2006/0235604 A1 10/2006 Taglialatela-Scafati et al.
2006/0253233 A1 11/2006 Metzger
2006/0271291 A1 11/2006 Meyer
2006/0277906 A1 12/2006 Burk et al.
2006/0282199 A1 12/2006 Daum et al.
2007/0006831 A1 1/2007 Leone et al.
2007/0061053 A1 3/2007 Zeitzew
2007/0062476 A1 3/2007 Ota et al.
2007/0073466 A1 3/2007 Tamai et al.
2007/0078026 A1 4/2007 Holt et al.
2007/0093148 A1 4/2007 Gibbs et al.
2007/0108308 A1 5/2007 Keightley
2007/0112475 A1 5/2007 Koebler et al.

(56) References Cited

U.S. PATENT DOCUMENTS

| | | | | |
|---|---|---|---|---|
| 2007/0129852 | A1 | 6/2007 | Chen et al. | |
| 2007/0135988 | A1 | 6/2007 | Kidston et al. | |
| 2007/0137514 | A1 | 6/2007 | Kumar et al. | |
| 2007/0183039 | A1 | 8/2007 | Irvin | |
| 2007/0203203 | A1 | 8/2007 | Tao et al. | |
| 2007/0209619 | A1 | 9/2007 | Leone | |
| 2007/0219680 | A1 | 9/2007 | Kumar et al. | |
| 2007/0219681 | A1 | 9/2007 | Kumar et al. | |
| 2007/0219682 | A1 | 9/2007 | Kumar et al. | |
| 2007/0219683 | A1 | 9/2007 | Daum et al. | |
| 2007/0225878 | A1 | 9/2007 | Kumar et al. | |
| 2007/0233335 | A1 | 10/2007 | Kumar et al. | |
| 2007/0233364 | A1 | 10/2007 | Kumar | |
| 2007/0241237 | A1 | 10/2007 | Foy et al. | |
| 2007/0250225 | A1 | 10/2007 | Nickles et al. | |
| 2007/0250255 | A1 | 10/2007 | Matekunas et al. | |
| 2007/0260367 | A1 | 11/2007 | Wills et al. | |
| 2007/0260369 | A1 | 11/2007 | Philp et al. | |
| 2007/0261648 | A1 | 11/2007 | Reckels et al. | |
| 2007/0274158 | A1 | 11/2007 | Agam et al. | |
| 2008/0004721 | A1 | 1/2008 | Huff et al. | |
| 2008/0105791 | A1* | 5/2008 | Karg | B61K 9/10 246/120 |
| 2009/0193899 | A1* | 8/2009 | Panetta | G01N 29/07 73/622 |
| 2012/0217351 | A1 | 8/2012 | Chadwick et al. | |
| 2013/0015298 | A1* | 1/2013 | Cooper | B61L 3/065 246/182 R |
| 2013/0062474 | A1 | 3/2013 | Baldwin et al. | |
| 2013/0284859 | A1* | 10/2013 | Polivka | B61L 27/0055 246/34 R |
| 2013/0334373 | A1 | 12/2013 | Malone, Jr. et al. | |
| 2014/0129154 | A1* | 5/2014 | Cooper | B61L 3/121 702/34 |
| 2014/0156123 | A1 | 6/2014 | Cooper et al. | |
| 2014/0207317 | A1 | 7/2014 | Noffsinger et al. | |
| 2014/0277824 | A1* | 9/2014 | Kernwein | B61K 9/08 701/1 |
| 2014/0280899 | A1* | 9/2014 | Brewster, Jr. | H04L 43/0817 709/224 |

FOREIGN PATENT DOCUMENTS

| | | | |
|---|---|---|---|
| DE | 102010026433 | A1 | 1/2012 |
| JP | 2002-294609 | * | 1/2001 |
| WO | 9858829 | A1 | 12/1998 |
| WO | 2014193610 | A1 | 12/2014 |

OTHER PUBLICATIONS

Zhang, S.; Lee, W.K.; Pong, P.; "Train Detection by Magnetic Field Sensing", Sensors and Materials, vol. 25, No. 6, Feb. 4, 2013; pp. 423-436.

U.S. Appl. No. 14/527,246, filed Oct. 29, 2014, Joseph Forrest Noffsinger.

U.S. Appl. No. 61/729,188, filed Nov. 21, 2012, Jared Klineman Cooper.

U.S. Appl. No. 14/657,233, filed Mar. 13, 2015, Jared Klineman Cooper.

U.S. Appl. No. 14/841,209, filed Aug. 31, 2015, Yuri Alexeyevich Plotnikov.

U.S. Appl. No. 15/047,083, filed Feb. 18, 2016, Brett Alexander Matthews.

U.S. Appl. No. 62/161,626, filed May 14, 2015, Joseph Forrest Noffsinger.

Dick et al., "Multivariate statistical Model for Predicting Occurrence and Location of Broken Rails", Transportation Research Record: Journal of the Transportation Research Board, 1825(1), pp. 48-55, 2003.

Hou et al., "A Rail Damage Detection and Measurement System Using Neural Networks", 2004 IEEE International Conference on Computational Intelligence for Measurement Systems and Applications, 2004. CIMSA, pp. 4-9, Jul. 14-16, 2004.

Chen et al., "Fault Detection and Diagnosis for Railway Track Circuits Using Neuro-Fuzzy Systems", ScienceDirect Control Engineering Practice, pp. 585-596, May 2008.

Ho et al., "Signature Analysis on Wheel-Rail Interaction for Rail Defect Detection", 2008 4th IET International Conference on Railway Condition Monitoring, pp. 1-6, Jun. 18-20, 2008.

Schafer II, "Effect of Train Length on Railroad Accidents and a Quantitative Analysis of Factors Affecting Broken Rails". Thesis, University of Illinois at Urbana-Champaign 2008.

Patra et al., "Availability Analysis of Railway Track Circuits", Proceedings of the Institution of Mechanical Engineers, Part F: Journal of Rail and Rapid Transit, vol. 224 No. 3, pp. 169-177, May 1, 2010.

Kun-Peng et al., "Design of transmission system of real-time broken rail detection", Journal of Railway Science and Engineering, Jan. 2013.

Maldonado et al., "Autonomous Broken Rail Detection Technology for Use on Revenue Service Trains", U.S. Department of Transportation, Federal Railroad Administration, Dec. 2014.

PCT Search Report and Written Opinion issued in connection with related PCT Application No. PCT/US2013/053124 on Jul. 4, 2014.

PCT Invitation to Pay Additional Fees issued in connection with related PCT Application No. PCT/US2013/053124 on Apr. 2, 2014.

* cited by examiner

ROUTE EXAMINING SYSTEM AND METHOD

CROSS-REFERENCE TO RELATED APPLICATIONS

This application claims priority to U.S. Provisional Application No. 61/985,103, which was filed 28 Apr. 2014, and is entitled "Route Examining System and Method" (the "'103 application"). The entire disclosure of the '103 disclosure is incorporated by reference. This application is a continuation-in-part of U.S. patent application Ser. No. 14/527,246, which was filed 29 Oct. 2014, and is entitled "Route Examining System and Method" (the "'246 application"). The entire disclosure of the '246 disclosure is incorporated by reference. The'246 application is a continuation-in-part of U.S. patent application Ser. No. 14/016,310, which was filed 5 Sep. 2013, and is entitled "Route Examining System And Method" (the "'310 application"). The entire disclosure of the '310 application is incorporated by reference. The '310 application claims priority to U.S. Provisional Application No. 61/729,188, which was filed on 21 Nov. 2012, and is entitled "Route Examining System And Method" (the "'188 application"). The entire disclosure of the '188 application is incorporated by reference.

TECHNICAL FIELD

Embodiments of the subject matter disclosed herein relate to examining routes traveled by vehicles for damage to the routes.

BACKGROUND

Routes that are traveled by vehicles may become damaged over time with extended use. For example, tracks on which rail vehicles travel may become damaged and/or broken. A variety of known systems are used to examine rail tracks to identify where the damaged and/or broken portions of the track are located. For example, some systems use cameras, lasers, and the like, to optically detect breaks and damage to the tracks. The cameras and lasers may be mounted on the rail vehicles, but the accuracy of the cameras and lasers may be limited by the speed at which the rail vehicles move during inspection of the route. As a result, the cameras and lasers may not be able to be used during regular operation (e.g., travel) of the rail vehicles in revenue service.

Other systems use ultrasonic transducers that are placed at or near the tracks to ultrasonically inspect the tracks. These systems may require very slow movement of the transducers relative to the tracks in order to detect damage to the track. When a suspect location is found by an ultrasonic inspection vehicle, a follow-up manual inspection may be required for confirmation of defects using transducers that are manually positioned and moved along the track and/or are moved along the track by a relatively slower moving inspection vehicle. Inspections of the track can take a considerable amount of time, during which the inspected section of the route may be unusable by regular route traffic.

Other systems use human inspectors who move along the track to inspect for broken and/or damaged sections of track. This manual inspection is slow and prone to errors.

Other systems use wayside devices that send electric signals through the tracks. If the signals are not received by other wayside devices, then a circuit that includes the track is identified as being open and the track is considered to be broken. These systems are limited at least in that the wayside devices are immobile. As a result, the systems cannot inspect large spans of track and/or a large number of devices must be installed in order to inspect the large spans of track. These systems are also limited at least in that a single circuit could stretch for multiple miles. As a result, if the track is identified as being open and is considered broken, it is difficult and time-consuming to locate the exact location of the break within the long circuit. For example, a maintainer must patrol the length of the circuit to locate the problem.

These systems are also limited at least in that other track features, such as highway (e.g., hard wire) crossing shunts, wide band (e.g., capacitors) crossing shunts, narrow band (e.g., tuned) crossing shunts, switches, insulated joints, and turnouts (e.g., track switches) may emulate the signal response expected from a broken rail and provide a false alarm. For example, scrap metal on the track, crossing shunts, etc., may short the rails together, preventing the current from traversing the length of the circuit, indicating that the circuit is open. Additionally, insulated joints and/or turnouts may include intentional conductive breaks that create an open circuit. In response, the system may identify a potentially broken section of track, and a person or machine may be dispatched to patrol the circuit to locate the break, even if the detected break is a false alarm (e.g., not a break in the track). A need remains to reduce the probability of false alarms to make route maintenance more efficient.

Further, even systems that may be able to identify that a particular section of track may be damaged, may not be able to distinguish between faults or to identify a specific location of a particular fault. Thus, a maintainer may be dispatched to address the fault, but may be provided with little or no diagnostic information in advance. Accordingly, the maintainer may be required to walk a circuit (which may be between 2-3 miles in length) and/or perform numerous tests to find the fault, identify the fault, and repair or address the fault. Depending on the equipment needed for tests and/or repairs, the maintainer may take several trips to and from the site of the fault. Further, the maintainer may need to call out one or more additional maintainers, or, if the fault is a type the maintainer is not suited to address, the maintainer may need to call a different maintainer to perform repairs. When faults occur in signaled territory, for example, the time required under conventional systems for a maintainer to be dispatched, identify a fault, and effectuate repairs may result in lengthy and/or costly delays, traffic jams, or the like.

BRIEF DESCRIPTION

In an embodiment, a system includes first and second application devices, a control unit, and at least one processor. The first and second application devices are configured to be disposed onboard a vehicle system having at least one vehicle and configured to travel along a route having first and second conductive tracks, with the first and second application devices each configured to be at least one of conductively or inductively coupled with one of the conductive tracks. The control unit is configured to control supply of electric current from a power source to the first and second application devices in order to electrically inject a first examination signal into the conductive tracks via the first application device and to electrically inject a second examination signal into the conductive tracks via the second application device. The at least one processor is configured to be disposed onboard the vehicle system, and to be operably coupled with first and second detection devices disposed onboard the vehicle system. The first and second detection devices are configured to detect the injected examination signals. The at least one processor is configured to monitor one or more electrical characteristics of the first and second conductive tracks in response to the first and second examination signals being injected into the conductive tracks, and to identify a type of fault based upon the one or more electrical characteristics of the first and second conductive tracks.

In an embodiment, a method includes electrically injecting, via first and second application devices, first and second examination signals into first and second conductive tracks of a route being traveled by a vehicle system having at least one vehicle, with the first and second examination signals being injected at spaced apart locations along a length of the vehicle system. The method also includes monitoring, via first and second detection devices, one or more electrical characteristics of the first and second conductive tracks at first and second monitoring locations that are onboard the vehicle system in response to the first and second examination signals being injected into the conductive tracks, with the first monitoring location spaced apart along the length of the vehicle relative to the second monitoring location. Also, the method includes identifying a type of fault along the route based upon the one or more electrical characteristics monitored at the first and second monitoring locations.

BRIEF DESCRIPTION OF THE DRAWINGS

Reference is made to the accompanying drawings in which particular embodiments and further benefits of the invention are illustrated as described in more detail in the description below, in which.

DETAILED DESCRIPTION

Figure 1:
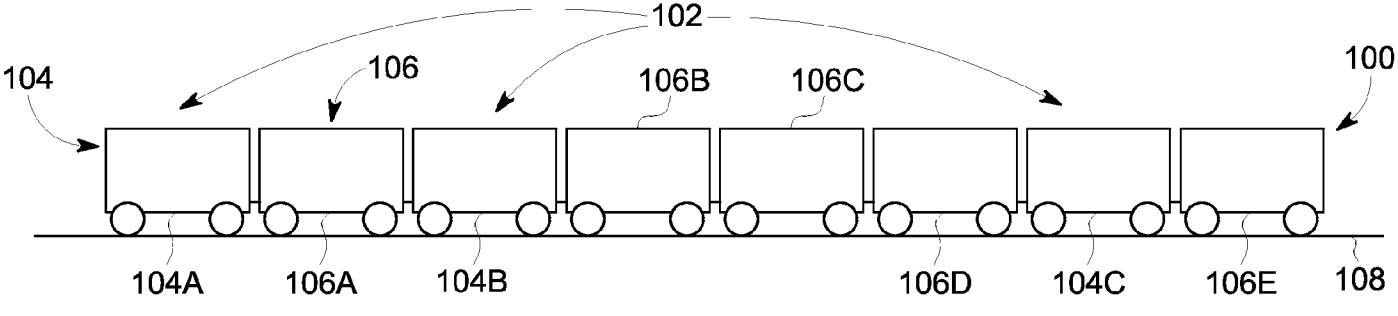
FIG. 1 is a schematic illustration of a vehicle system that includes an embodiment of a route examining system.

Embodiments of the inventive subject matter relate to methods and systems for examining a route being traveled upon by a vehicle system in order to identify potential sections of the route that are damaged or broken. In an embodiment, the vehicle system may examine the route by injecting an electrical signal into the route from a first vehicle in the vehicle system as the vehicle system travels along the route and monitoring the route at another, second vehicle that also is in the vehicle system. Detection of the signal at the second vehicle and/or detection of changes in the signal at the second vehicle may indicate a potentially damaged (e.g., broken or partially broken) section of the route between the first and second vehicles. In an embodiment, the route may be a track of a rail vehicle system and the first and second vehicle may be used to identify a broken or partially broken section of one or more rails of the track. The electrical signal that is injected into the route may be powered by an onboard energy storage device, such as one or more batteries, and/or an off-board energy source, such as a catenary and/or electrified rail of the route. When the damaged section of the route is identified, one or more responsive actions may be initiated. For example, the vehicle system may automatically slow down or stop. As another example, a warning signal may be communicated (e.g., transmitted or broadcast) to one or more other vehicle systems to warn the other vehicle systems of the damaged section of the route, to one or more wayside devices disposed at or near the route so that the wayside devices can communicate the warning signals to one or more other vehicle systems. In another example, the warning signal may be communicated to an off-board facility that can arrange for the repair and/or further examination of the damaged section of the route.

Embodiments of the inventive subject matter relate to methods and systems for examining a route and identifying specific types of faults and the locations of the faults. For example, when operated in territory with circuited track, such as in conventional signal systems, or, as another example, on approaches to or within an island of a highway crossing warning system, track signatures corresponding to injected signals may be analyzed to determine if a fault condition is present in the track circuit. Based on the analysis, a fault status, classification of fault type, and specific location of the fault may be output. For example, the fault status, classification of fault type, and specific location of the fault may be provided (e.g., displayed or transmitted) to one or more of a vehicle driver or operator, a train dispatch center, a maintenance center, a mobile device of maintenance person responsible for a portion of a route corresponding to the fault, a web server by inspection of responsible persons, or the like.

It may be noted that track circuits may fail from one or more of a number of conditions. For example, broken rails may be a source of track circuit failure. Additional causes of track circuit failure include shorts on the track, for example caused by scrap metal across the track. Scrap metal shorting a track may be caused, for example, by steel banding that has fallen off of freight cars, trash left on the track, or objects placed by trespassers. Shorts may also be caused by failed insulation in switch appliances such as switch rods and gauge plates. An additional cause of failure may be attributable to defective insulated joints in the rail at the ends of a circuit. Such defective insulated joints may allow a track circuit to be connected to an adjacent track circuit. Because the adjacent track circuits may be designed to operate using opposite polarity relative to one another for safety, one or both of the adjacent circuits may fail due to one or more defective insulated joints. A further potential fault of a track circuit may be due to failure of a transmitter configured to transmit track circuit signals to the track. In various embodiments, one or more of the above discussed (and/or additional or alternative faults) may be specifically identified by type of fault and location.

By providing an appropriate entity with information describing both the type of failure as well as a location of the failure, various embodiments provide improved maintenance and/or operation of a vehicle system and/or network. Further, various embodiments improve the efficiency of repairs or maintenance. Various embodiments also increase efficiency and/or reduce labor costs (for example, reducing the time expended by laborers and/or the number of laborers required to identify and address a fault). By improving the time used to repair or address faults, various embodiments minimize the number of vehicles impacted by stop signals or other causes of delay associated with a failure, as well as minimizing related traffic jams.

The term "vehicle" as used herein can be defined as a mobile machine that transports at least one of a person, people, or a cargo. For instance, a vehicle can be, but is not limited to being, a rail car, an intermodal container, a locomotive, a marine vessel, mining equipment, construction equipment, an automobile, and the like. A "vehicle system" includes at least one vehicle. In some embodiments, a vehicle system may include two or more vehicles that are interconnected with each other to travel along a route. For example, a vehicle system can include two or more vehicles that are directly connected to each other (e.g., by a coupler) or that are indirectly connected with each other (e.g., by one or more other vehicles and couplers). A vehicle system can be referred to as a consist, such as a rail vehicle consist.

"Software" or "computer program" as used herein includes, but is not limited to, one or more computer readable and/or executable instructions that cause a computer or other electronic device to perform functions, actions, and/or behave in a desired manner. The instructions may be embodied in various forms such as routines, algorithms, modules or programs including separate applications or code from dynamically linked libraries. Software may also be implemented in various forms such as a stand-alone program, a function call, a servlet, an applet, an application, instructions stored in a memory, part of an operating system or other type of executable instructions. "Computer" or "processing element" or "computer device" or "processor" or "processing unit" as used herein includes, but is not limited to, any programmed or programmable electronic device that can store, retrieve, and process data. "Non-transitory computer-readable media" include, but are not limited to, a CD-ROM, a removable flash memory card, a hard disk drive, a magnetic tape, and a floppy disk. "Computer memory", as used herein, refers to a storage device configured to store digital data or information which can be retrieved by a computer or processing element. "Controller," "unit," and/or "module," as used herein, can to the logic circuitry and/or processing elements and associated software or program involved in controlling an energy storage system. The terms "signal", "data", and "information" may be used interchangeably herein and may refer to digital or analog forms.

FIG. 1 is a schematic illustration of a vehicle system 100 that includes an embodiment of a route examining system 102. The vehicle system 100 includes several vehicles 104, 106 that are mechanically connected with each other to travel along a route 108. The vehicles 104 (e.g., the vehicles 104A-C) represent propulsion-generating vehicles, such as vehicles that generate tractive effort or power in order to propel the vehicle system 100 along the route 108. In an embodiment, the vehicles 104 can represent rail vehicles such as locomotives. The vehicles 106 (e.g., the vehicles 106A-E) represent non-propulsion generating vehicles, such as vehicles that do not generate tractive effort or power. In an embodiment, the vehicles 106 can represent rail cars. Alternatively, the vehicles 104, 106 may represent other types of vehicles. In another embodiment, one or more of the individual vehicles 104 and/or 106 represent a group of vehicles, such as a consist of locomotives or other vehicles.

The route 108 can be a body, surface, or medium on which the vehicle system 100 travels. In an embodiment, the route 108 can include or represent a body that is capable of conveying a signal between vehicles in the vehicle system 100, such as a conductive body capable of conveying an electrical signal (e.g., a direct current, alternating current, radio frequency, or other signal).

The examining system 102 can be distributed between or among two or more vehicles 104, 106 of the vehicle system 100. For example, the examining system 102 may include two or more components that operate to identify potentially damaged sections of the route 108, with at least one component disposed on each of two different vehicles 104, 106 in the same vehicle system 100. In the illustrated embodiment, the examining system 102 is distributed between or among two different vehicles 104. Alternatively, the examining system 102 may be distributed among three or more vehicles 104, 106. Additionally or alternatively, the examining system 102 may be distributed between one or more vehicles 104 and one or more vehicles 106, and is not limited to being disposed onboard a single type of vehicle 104 or 106. As described below, in another embodiment, the examining system 102 may be distributed between a vehicle in the vehicle system and an off-board monitoring location, such as a wayside device.

In operation, the vehicle system 100 travels along the route 108. A first vehicle 104 electrically injects an examination signal into the route 108. For example, the first vehicle 104A may apply a direct current, alternating current, radio frequency signal, or the like, to the route 108 as an examination signal. The examination signal propagates through or along the route 108. A second vehicle 104B or 104C may monitor one or more electrical characteristics of the route 108 when the examination signal is injected into the route 108.

The examining system 102 can be distributed among two separate vehicles 104 and/or 106. In the illustrated embodiment, the examining system 102 has components disposed onboard at least two of the propulsion-generating vehicles 104A, 104B, 104C. Additionally or alternatively, the examining system 102 may include components disposed onboard at least one of the non-propulsion generating vehicles 106. For example, the examining system 102 may be located onboard two or more propulsion-generating vehicles 104, two or more non-propulsion generating vehicles 106, or at least one propulsion-generating vehicle 104 and at least one non-propulsion generating vehicle 106.

In operation, during travel of the vehicle system 100 along the route 108, the examining system 102 electrically injects an examination signal into the route 108 at a first vehicle 104 or 106 (e.g., beneath the footprint of the first vehicle 104 or 106). For example, an onboard or off-board power source may be controlled to apply a direct current, alternating current, RF signal, or the like, to a track of the route 108. The examining system 102 monitors electrical characteristics of the route 108 at a second vehicle 104 or 106 of the same vehicle system 100 (e.g., beneath the footprint of the second vehicle 104 or 106) in order to determine if the examination signal is detected in the route 108. For example, the voltage, current, resistance, impedance, or other electrical characteristic of the route 108 may be monitored at the second vehicle 104, 106 in order to determine if the examination signal is detected and/or if the examination signal has been altered. If the portion of the route 108 between the first and second vehicles conducts the examination signal to the second vehicle, then the examination signal may be detected by the examining system 102. The examining system 102 may determine that the route 108 (e.g., the portion of the route 108 through which the examination signal propagated) is intact and/or not damaged.

On the other hand, if the portion of the route 108 between the first and second vehicles does not conduct the examination signal to the second vehicle (e.g., such that the examination signal is not detected in the route 108 at the second vehicle), then the examination signal may not be detected by the examining system 102. The examining system 102 may determine that the route 108 (e.g., the portion of the route 108 disposed between the first and second vehicles during the time period that the examination signal is expected or calculated to propagate through the route 108) is not intact and/or is damaged. For example, the examining system 102 may determine that the portion of a track between the first and second vehicles is broken such that a continuous conductive pathway for propagation of the examination signal does not exist. The examining system 102 can identify this section of the route as being a potentially damaged section of the route 108. In routes 108 that are segmented (e.g., such as rail tracks that may have gaps), the examining system 102 may transmit and attempt to detect multiple examination signals in order to prevent false detection of a broken portion of the route 108.

Because the examination signal may propagate relatively quickly through the route 108 (e.g., faster than a speed at which the vehicle system 100 moves), the route 108 can be examined using the examination signal when the vehicle system 100 is moving, such as transporting cargo or otherwise operating at or above a non-zero, minimum speed limit of the route 108.

Additionally or alternatively, the examining system 102 may detect one or more changes in the examination signal at the second vehicle. The examination signal may propagate through the route 108 from the first vehicle to the second vehicle. But, due to damaged portions of the route 108 between the first and second vehicles, one or more signal characteristics of the examination signal may have changed. For example, the signal-to-noise ratio, intensity, power, or the like, of the examination signal may be known or designated when injected into the route 108 at the first vehicle. One or more of these signal characteristics may change (e.g., deteriorate or decrease) during propagation through a mechanically damaged or deteriorated portion of the route 108, even though the examination signal is received (e.g., detected) at the second vehicle. The signal characteristics can be monitored upon receipt of the examination signal at the second vehicle. Based on changes in one or more of the signal characteristics, the examining system 102 may identify the portion of the route 108 that is disposed between the first and second vehicles as being a potentially damaged portion of the route 108. For example, if the signal-to-noise ratio, intensity, power, or the like, of the examination signal decreases below a designated threshold and/or decreases by more than a designated threshold decrease, then the examining system 102 may identify the section of the route 108 as being potentially damaged. Further, as the vehicle system 100 passes over a given fault (e.g., short, broken rail, defective insulated joint, broken wire bond) the monitored signal(s) may have a signature (e.g., distinctive waveform or shape) that corresponds to a particular fault. The examining system 102 may identify the particular type of fault based on the signature of the monitored signal(s). For example, representative signatures correlated with corresponding faults may be stored in a database stored on or available to the vehicle system 100, and an acquired signature may be compared with the representative signatures (e.g., by the examining system 102) to identify a fault corresponding with the acquired signature.

For example, the examining system 102 may distinguish between different types of short circuits, such as shorts caused by metal (e.g., metal banding on the track) and failed insulation joints. In some embodiments, the signatures of a short caused by metal and a short caused by failed insulation (e.g. of one or more attribute of a switch) may differ enough for the types of short to be identified using the signal. Additionally or alternatively, a location of a fault may be used in determining the type of fault. For example, the location of insulated joints may be stored in a database stored on or available to the vehicle system 100. If a detected short occurs at a location corresponding to a location of a switch, the examining system 102 may determine that the short is (or likely is or potentially is) caused by failed insulation of a switch. If, however, the location of the short does not correspond to a switch (or attribute thereof) and/or other known component that may fail to cause a short, the examining system may determine that the short is (or likely is or potentially is) caused by metal on the track.

As another example, the examining system 102 may distinguish between faults associated with an inhibition or prevention of transmitting a signal through a track, such as distinguishing between broken rail and an insulated joint. For example, if a signal characteristic is observed that may indicate either an insulated joint or a broken rail, the examining system 102 may undertake further analysis. For instance, if the signal characteristic occurs on both sides of a track (e.g., the signal characteristic appears on both sides of the track spaced at an interval corresponding to a distance at which the joints of the sides of the track are staggered with respect to each other), the examining system 102 may determine that the observed characteristic is (or likely is or potentially is) due to insulated joints. As another example, if the characteristic is observed on only one side of the track but the location corresponds to a known (e.g., via a database of predetermined insulated joint locations along the route) location of an insulated joint, the examining system may determine that the observed characteristic is (or likely is or potentially is) due to a pair of insulated joints, one defective and one not. On the other hand, if the characteristic is observed on only one side of the track and does not correspond to a known insulated joint location, the examining system 102 may determine that the characteristic is (or likely is or potentially is) due to a broken rail. Additionally or alternatively, the examining system 102 may determine the location of a faulty insulated joint using a database of known insulated joint locations. If an expected interruption in a signal or electrical characteristic associated with an insulated joint is not observed at an observation location corresponding to a known insulated joint location, the examining system 102 may determine that a faulty insulated joint is located at the observation location.

In response to identifying a section of the route 108 as being damaged or damaged, the examining system 102 may initiate one or more responsive actions. For example, the examining system 102 can automatically slow down or stop movement of the vehicle system 100. The examining system 102 can automatically issue a warning signal to one or more other vehicle systems traveling nearby of the damaged section of the route 108 and where the damaged section of the route 108 is located. The examining system 102 may automatically communicate a warning signal to a stationary wayside device located at or near the route 108 that notifies the device of the potentially damaged section of the route 108 and the location of the potentially damaged section. The stationary wayside device can then communicate a signal to one or more other vehicle systems traveling nearby of the potentially damaged section of the route 108 and where the potentially damaged section of the route 108 is located. The examining system 102 may automatically issue an inspection signal to an off-board facility, such as a repair facility, that notifies the facility of the potentially damaged section of the route 108 and the location of the section. The facility may then send one or more inspectors to check and/or repair the route 108 at the potentially damaged section. Alternatively, the examining system 102 may notify an operator of the potentially damaged section of the route 108 and the operator may then manually initiate one or more responsive actions.

Additionally or alternatively, the examining system 102 may notify an off-board entity of the particular location of a specific type of identified fault. Further, the identity of the off-board entity notified may be selected based on the type of identified fault. A particular off-board entity most appropriate for addressing a given identified fault may be selected from a plurality of off-board entities based on the given identified fault. For example, if a transmitter of a signal system is identified as having a fault, a signal system maintainer may be notified (directly and/or indirectly through a dispatch system) of the fault. As another example, if a broken rail is identified, a track maintenance entity may be notified. In various embodiments, the examining system 102 may provide a maintenance interface for maintenance personnel and/or dispatching personnel providing information regarding both a particular fault or cause of a fault as well as a location using monitored examination signals. By providing more detailed information, the examining system 102 may help reduce the time required to address a fault. For example, with the type and/or cause of fault known, the appropriate personnel and/or appropriate equipment may be immediately sent to a location of the fault.

Figure 2:
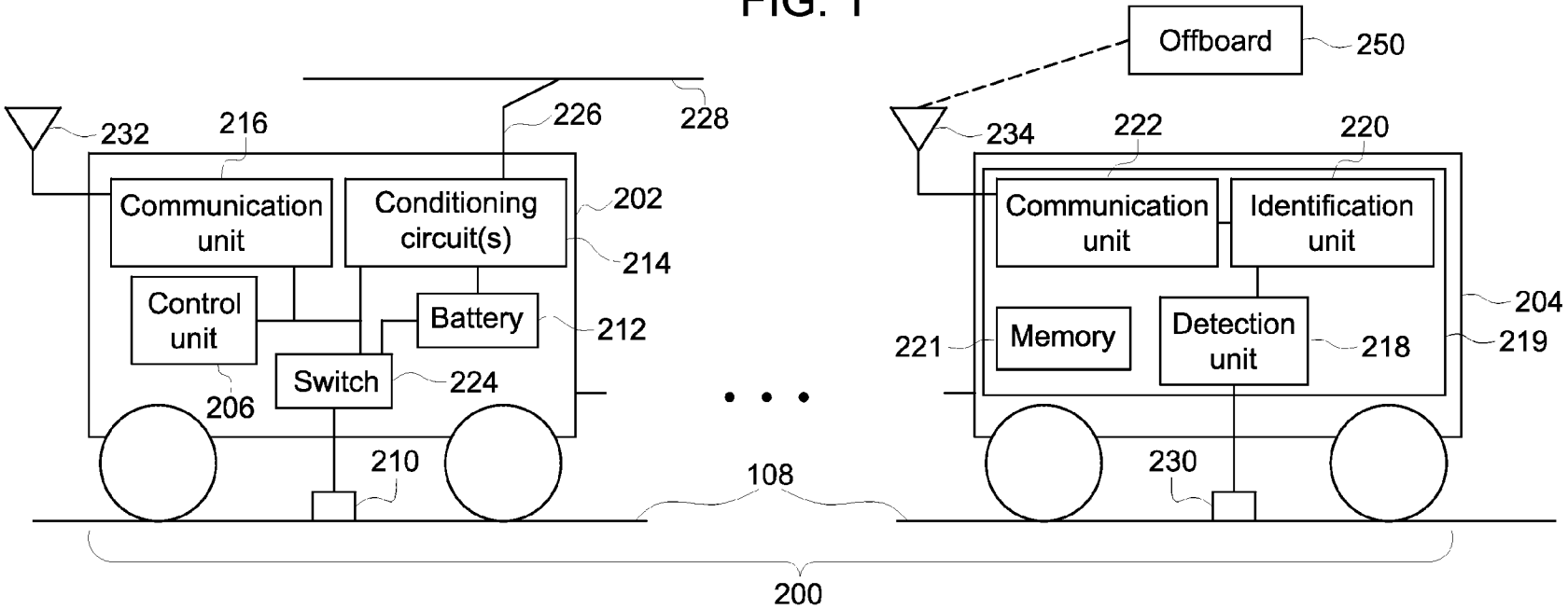
FIG. 2 is a schematic illustration of an embodiment of an examining system.

FIG. 2 is a schematic illustration of an embodiment of an examining system 200. The examining system 200 may represent the examining system 102 shown in FIG. 1. The examining system 200 is distributed between a first vehicle 202 and a second vehicle 204 in the same vehicle system. The vehicles 202, 204 may represent vehicles 104 and/or 106 of the vehicle system 100 shown in FIG. 1. In an embodiment, the vehicles 202, 204 represent two of the vehicles 104, such as the vehicle 104A and the vehicle 104B, the vehicle 104B and the vehicle 104C, or the vehicle 104A and the vehicle 104C. Alternatively, one or more of the vehicles 202, 204 may represent at least one of the vehicles 106. In another embodiment, the examining system 200 may be distributed among three or more of the vehicles 104 and/or 106. In other embodiments, the examining system 200 may be disposed upon a single vehicle.

The examining system 200 includes several components described below that are disposed onboard the vehicles 202, 204. For example, the illustrated embodiment of the examining system 200 includes a control unit 208, an application device 210, an onboard power source 212 ("Battery" in FIG. 2), one or more conditioning circuits 214, a communication unit 216, and one or more switches 224 disposed onboard the first vehicle 202. The examining system 200 also includes a detection unit 218, an identification unit 220, a detection device 230, and a communication unit 222 disposed onboard the second vehicle 204. Alternatively, one or more of the control unit 208, application device 210, power source 212, conditioning circuits 214, communication unit 216, and/or switch 224 may be disposed onboard the second vehicle 204 and/or another vehicle in the same vehicle system, and/or one or more of the detection unit 218, identification unit 220, detection device 230, and communication unit 222 may be disposed onboard the first vehicle 202 and/or another vehicle in the same vehicle system. It may be noted that in the illustrated embodiment, the detection device 230 and the application device 220 are schematically depicted as being disposed in intermediate positions between axles of different vehicles. For example, the detection device 230 and application device 210 in various embodiments may be located as shown and may be configured to transmit and receive signals via an additional rail not in electrical communication with the axles of the vehicles 202, 204. In other embodiments, the detection device 230 and application device 210 may be configured to transmit and receive signals transmitted through tracks contacted by wheels of the vehicles 202, 204, and may be disposed at nearest ends of adjacent vehicles, without any axles interposed between the detection device 230 and the application device 210, to reduce any signal transmission issues that may be affected by shunting by the axles.

The control unit 206 controls supply of electric current to the application device 210. In an embodiment, the application device 210 includes one or more conductive bodies that engage the route 108 as the vehicle system that includes the vehicle 202 travels along the route 108. For example, the application device 210 can include a conductive shoe, brush, or other body that slides along an upper and/or side surface of a track such that a conductive pathway is created that extends through the application device 210 and the track. Additionally or alternatively, the application device 210 can include a conductive portion of a wheel of the first vehicle 202, such as the conductive outer periphery or circumference of the wheel that engages the route 108 as the first vehicle 202 travels along the route 108. In another embodiment, the application device 210 may be inductively coupled with the route 108 without engaging or touching the route 108 or any component that engages the route 108.

The application device 210 is conductively coupled with the switch 224, which can represent one or more devices that control the flow of electric current from the onboard power source 212 and/or the conditioning circuits 214. The switch 224 can be controlled by the control unit 206 so that the control unit 206 can turn on or off the flow of electric current through the application device 210 to the route 108. In an embodiment, the switch 224 also can be controlled by the control unit 206 to vary one or more waveforms and/or waveform characteristics (e.g., phase, frequency, amplitude, and the like) of the current that is applied to the route 108 by the application device 210.

The onboard power source 212 represents one or more devices capable of storing electric energy, such as one or more batteries, capacitors, flywheels, and the like. Additionally or alternatively, the power source 212 may represent one or more devices capable of generating electric current, such as an alternator, generator, photovoltaic device, gas turbine, or the like. The power source 212 is coupled with the switch 224 so that the control unit 206 can control when the electric energy stored in the power source 212 and/or the electric current generated by the power source 212 is conveyed as electric current (e.g., direct current, alternating current, an RF signal, or the like) to the route 108 via the application device 210.

The conditioning circuit 214 represents one or more circuits and electric components that change characteristics of electric current. For example, the conditioning circuit 214 may include one or more inverters, converters, transformers, batteries, capacitors, resistors, inductors, and the like. In the illustrated embodiment, the conditioning circuit 214 is coupled with a connecting assembly 226 that is configured to receive electric current from an off-board source. For example, the connecting assembly 226 may include a pantograph that engages an electrified conductive pathway 228 (e.g., a catenary) extending along the route 108 such that the electric current from the catenary 228 is conveyed via the connecting assembly 226 to the conditioning circuit 214. Additionally or alternatively, the electrified conductive pathway 228 may represent an electrified portion of the route 108 (e.g., an electrified rail) and the connecting assembly 226 may include a conductive shoe, brush, portion of a wheel, or other body that engages the electrified portion of the route 108. Electric current is conveyed from the electrified portion of the route 108 through the connecting assembly 226 and to the conditioning circuit 214.

The electric current that is conveyed to the conditioning circuit 214 from the power source 212 and/or the off-board source (e.g., via the connecting assembly 226) can be altered by the conditioning circuit 214. For example, the conditioning circuit 214 can change the voltage, current, frequency, phase, magnitude, intensity, waveform, and the like, of the current that is received from the power source 212 and/or the connecting assembly 226. The modified current can be the examination signal that is electrically injected into the route 108 by the application device 210. Additionally or alternatively, the control unit 206 can form the examination signal by controlling the switch 224. For example, the examination signal can be formed by turning the switch 224 on to allow current to flow from the conditioning circuit 214 and/or the power source 212 to the application device 210.

In an embodiment, the control unit 206 may control the conditioning circuit 214 to form the examination signal. For example, the control unit 206 may control the conditioning circuit 214 to change the voltage, current, frequency, phase, magnitude, intensity, waveform, and the like, of the current that is received from the power source 212 and/or the connecting assembly 226 to form the examination signal.

The examination signal is conducted through the application device 210 to the route 108, and is electrically injected into a conductive portion of the route 108. For example, the examination signal may be conducted into a conductive track of the route 108. In another embodiment, the application device 210 may not directly engage (e.g., touch) the route 108, but may be wirelessly coupled with the route 108 in order to electrically inject the examination signal into the route 108 (e.g., via induction).

The conductive portion of the route 108 that extends between the first and second vehicles 202, 204 during travel of the vehicle system may form a track circuit through which the examination signal may be conducted. The first vehicle 202 can be coupled (e.g., coupled physically, coupled wirelessly, among others) to the track circuit by the application device 210. The power source (e.g., the onboard power source 212 and/or the off-board electrified conductive pathway 228) can transfer power (e.g., the examination signal) through the track circuit toward the second vehicle 204.

By way of example and not limitation, the first vehicle 202 can be coupled to a track of the route 108, and the track can be the track circuit that extends and conductively couples one or more components of the examining system 200 on the first vehicle 202 with one or more components of the examining system 200 on the second vehicle 204.

In an embodiment, the control unit 206 includes or represents a manager component. Such a manager component can be configured to activate a transmission of electric current into the route 108 via the application device 210. In another instance, the manager component can activate or deactivate a transfer of the portion of power from the onboard and/or off-board power source to the application device 210, such as by controlling the switch and/or conditioning circuit. Moreover, the manager component can adjust parameter(s) associated with the portion of power that is transferred to the route 108. For instance, the manager component can adjust an amount of power transferred, a frequency at which the power is transferred (e.g., a pulsed power delivery, AC power, among others), a duration of time the portion of power is transferred, among others. Such parameter(s) can be adjusted by the manager component based on at least one of a geographic location of the vehicle or the device or an identification of the device (e.g., type, location, make, model, among others).

The manager component can leverage a geographic location of the vehicle or the device in order to adjust a parameter for the portion of power that can be transferred to the device from the power source. For instance, the amount of power transferred can be adjusted by the manager component based on the device power input. By way of example and not limitation, the portion of power transferred can meet or be below the device power input in order to reduce risk of damage to the device. In another example, the geographic location of the vehicle and/or the device can be utilized to identify a particular device and, in turn, a power input for such device. The geographic location of the vehicle and/or the device can be ascertained by a location on a track circuit, identification of the track circuit, Global Positioning Service (GPS), among others.

The detection unit 218 disposed onboard the second vehicle 204 as shown in FIG. 2 monitors the route 108 to attempt to detect the examination signal that is injected into the route 108 by the first vehicle 202. The detection unit 218 is coupled with the detection device 230. In an embodiment, the detection device 230 includes one or more conductive bodies that engage the route 108 as the vehicle system that includes the vehicle 204 travels along the route 108. For example, the detection device 230 can include a conductive shoe, brush, or other body that slides along an upper and/or side surface of a track such that a conductive pathway is created that extends through the detection device 230 and the track. Additionally or alternatively, the detection device 230 can include a conductive portion of a wheel of the second vehicle 204, such as the conductive outer periphery or circumference of the wheel that engages the route 108 as the second vehicle 204 travels along the route 108. In another embodiment, the detection device 230 may be inductively coupled with the route 108 without engaging or touching the route 108 or any component that engages the route 108.

The detection unit 218 monitors one or more electrical characteristics of the route 108 using the detection device 230. For example, the voltage of a direct current conducted by the route 108 may be detected by monitoring the voltage conducted by from the route 108 to the detection device 230 and/or the current (e.g., frequency, amps, phases, or the like) of an alternating current or RF signal being conducted by the route 108 may be detected by monitoring the current conducted by the route 108 to the detection device 230. As another example, the signal-to-noise ratio of a signal being conducted by the detection device 230 from the route 108 may be detected by the detection unit 218 examining the signal conducted by the detection device 230 (e.g., a received signal) and comparing the received signal to a designated signal. For example, the examination signal that is injected into the route 108 using the application device 210 may include a designated signal or portion of a designated signal. The detection unit 218 may compare the received signal that is conducted from the route 108 into the detection device 230 with this designated signal in order to measure a signal-to-noise ratio of the received signal.

The detection unit 218 determines one or more electrical characteristics of the signal (e.g., voltage, frequency, phase, waveform, intensity, or the like) that is received (e.g., picked up) by the detection device 230 from the route 108 and reports the characteristics of the received signal to the identification unit 220. If no signal is received by the detection device 230, then the detection unit 218 may report the absence of such a signal to the identification unit 220. For example, if the detection unit 218 does not detect at least a designated voltage, designated current, or the like, as being received by the detection device 230, then the detection unit 218 may not detect any received signal. Alternatively or additionally, the detection unit 218 may communicate the detection of a signal that is received by the detection device 230 only upon detection of the signal by the detection device 230.

In an embodiment, the detection unit 218 may determine the characteristics of the signals received by the detection device 230 in response to a notification received from the control unit 206 in the first vehicle 202. For example, when the control unit 206 is to cause the application device 210 to inject the examination signal into the route 108, the control unit 206 may direct the communication unit 216 to transmit a notification signal to the detection device 230 via the communication unit 222 of the second vehicle 204. The communication units 216, 222 may include respective antennas 232, 234 and associated circuitry for wirelessly communicating signals between the vehicles 202, 204, and/or with off-board locations. The communication unit 216 may wirelessly transmit a notification to the detection unit 218 that instructs the detection unit 218 as to when the examination signal is to be input into the route 108. Additionally or alternatively, the communication units 216, 222 may be connected via one or more wires, cables, and the like, such as a multiple unit (MU) cable, train line, or other conductive pathway(s), to allow communication between the communication units 216, 222. In the illustrated embodiment, the detection unit 218, identification unit 220, and communication unit 222, along with a memory 221 (e.g., a tangible and non-transitory computer storage medium storing one or more instruction sets for performing tasks disclosed herein, storing one or more databases correlating signatures to track faults, storing locations of aspects such as insulated joints or switches, or the like) are shown as part of a processing unit 219. The processing unit 219 may include one or more processors. Alternatively, one or more aspects of the processing unit 219 may be a portion of an additional processing unit. In various embodiments the processing unit 219 includes processing circuitry configured to perform one or more tasks, functions, or steps discussed herein. It may be noted that "processing unit" as used herein is not intended to necessarily be limited to a single processor or computer. For example, the processing unit 219 may include multiple processors and/or computers, which may be integrated in a common housing or unit, or which may distributed among various units or housings. It may be noted that operations performed by the processing unit 219 (e.g., operations corresponding to process flows or methods discussed herein, or aspects thereof) may be sufficiently complex that the operations may not be performed by a human being within a reasonable time period. For example, the analysis of electrical characteristics of a signal, the analysis of a signature, the identification of a signature representing a fault from a database corresponding to a currently analyzed signature, or the like, may rely on or utilize computations that may not be completed by a person within a reasonable time period. In some embodiments, one or more aspects depicted as being on-board first vehicle 202 (e.g., control unit 206) may be incorporated into the processing unit 219.

The detection unit 218 may begin monitoring signals received by the detection device 230. For example, the detection unit 218 may not begin or resume monitoring the received signals of the detection device 230 unless or until the detection unit 218 is instructed that the control unit 206 is causing the injection of the examination signal into the route 108. Alternatively or additionally, the detection unit 218 may periodically monitor the detection device 230 for received signals and/or may monitor the detection device 230 for received signals upon being manually prompted by an operator of the examining system 200.

Figure 12:
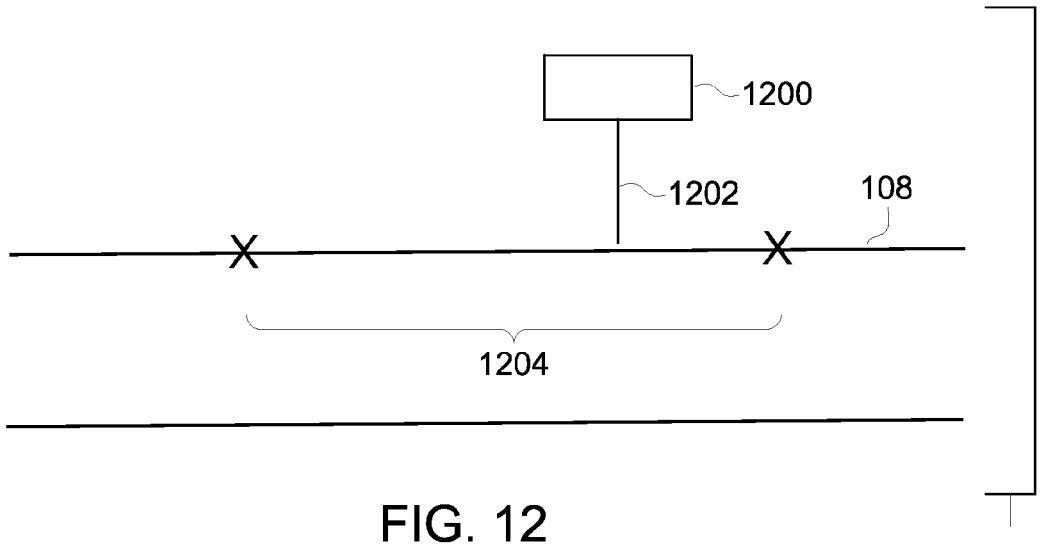
FIG. 12 is a schematic diagram of a transmitting system in accordance with an embodiment.

Additionally or alternatively, the detection unit 218 may also monitor signals provided by a transmitter coupled to the route 108. The transmitter may be disposed off-board of the vehicle system. For example, FIG. 12 illustrates a transmitter 1200 operably coupled to the route 108. The transmitter 1200 may be coupled to the route 108 via a conductive path 1202, and may provide track signals via one or more tracks of the route 108. The transmitter 1200 may be associated with a wayside device, for example a portion of a signaling system. Wayside transmitters, for example, may transmit signals having an assigned frequency within a range of about 500 Hz to about 15 kHz in some embodiments. Due to shunting by the axles, the signal from the transmitter 1200 may be generally undetectable by the detection unit 218. However, the vehicle may define a range 1204 (or test window) between the axles of the vehicle, with the signal from the transmitter 1200 detectable by the detection unit 218 when the point of contact between the route 108 and the conductive path 1202 (e.g., the point of transmission into the route 108 by the transmitter 1200) is positioned within the range 1204. Depending on the speed of a vehicle passing by the point of transmission into the route, the amount of time may be relatively short (e.g., less than a second) when the signal from the transmitter 1200 may be detected by the detection unit 218; however, enough information may be obtained to assess a health or condition of the transmitter 1200. For example, if the signal from the transmitter 1200 is at 500 Hz and collected over a 0.5 second period, about 250 waveforms from the transmitter may be obtained. By comparing a collected waveform with a known healthy waveform expected to be provided by a properly functioning transmitter, the health of the transmitter may be determined. It may be noted that one or more signals from other transmitters may be present on the track. Any signals from other transmitters, however, may be outside of the range 1204 or test window, as the transmitter 1200 being monitored as well as the detection unit 218 may be between axles which are shunting the track, preventing or reducing interference from any signals from any other transmitters. This helps ensure reduced interference of the signal from the transmitter 1200 being monitored, increasing accuracy in detection and identification of any potential faults with the transmitter 1200.

Figure 13:
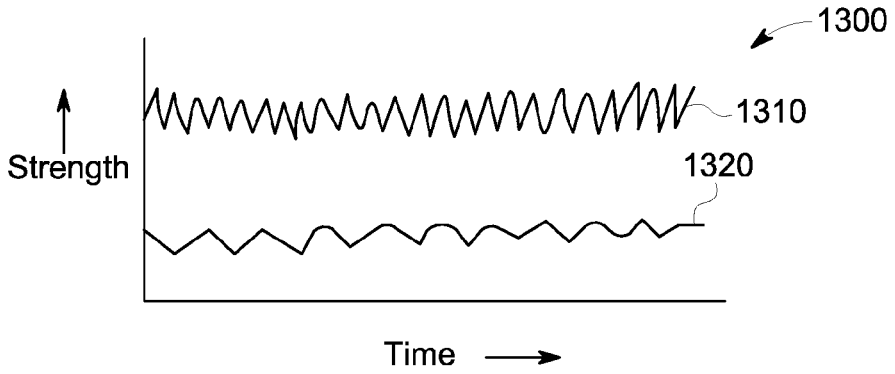
FIG. 13 depicts signals transmitted by the transmitting system of FIG. 12.

FIG. 13 provides a graph 1300 illustrating an example healthy signal 1310 and an example faulty signal 1320. The healthy signal 1310, for example, may be a calibrated value recorded by a vehicle passing over by the transmitter at a time of installation, initial set up, or other time when the transmitter is known to be healthy. The signals of FIG. 13 are intended for illustrative purposes only for simplicity of illustration and do not necessarily represent actual signals. As seen in FIG. 13, the faulty signal 1320 has a substantially lower amplitude or strength than the healthy signal 1310, and also has a different frequency. By monitoring changes in strength and/or frequency compared to a known healthy signal, the health of a transmitter providing the signal may be assessed. For example, if the signal obtained by the detection unit 218 drops below a threshold strength (and/or exhibits a difference in frequency or other characteristic from a baseline defined by a healthy signal), the transmitter may be identified as having a fault, and appropriate maintenance actions may be initiated. Further, by monitoring and recording the signal or characteristics of the signal over time, trends in the signal degradation may be observed, and maintenance activities may be scheduled based on the observed trend before the signal degrades past a threshold indicating a fault. For example, a trend in signal degradation may be identified based on a rate of decrease in signal strength (and/or a rate of change of frequency), or based on a threshold of signal strength (and/or frequency) that will be reached before a level of signal strength (and/or frequency) corresponding to a fault. Further still, a vehicle may be provided with a database listing locations of transmitters along the route 108. If the vehicle passes by an expected transmitter location without the detection unit 108 detecting a signal corresponding to a transmitted signal, the transmitter may be identified as being faulty.

Returning to FIG. 2, the identification unit 220 receives the characteristics of the received signal from the detection unit 218 and determines if the characteristics indicate receipt of all or a portion of the examination signal injected into the route 108 by the first vehicle 202. Although the detection unit 218 and the identification unit 220 are shown as separate units, the detection unit 218 and the identification unit 220 may refer to the same unit. For example, the detection unit 218 and the identification unit 220 may be a single hardware component disposed onboard the second vehicle 204.

The identification unit 220 examines the characteristics and determines if the characteristics indicate that the section of the route 108 disposed between the first vehicle 202 and the second vehicle 204 is damaged or at least partially damaged. For example, if the application device 210 injected the examination signal into a track of the route 108 and one or more characteristics (e.g., voltage, current, frequency, intensity, signal-to-noise ratio, and the like) of the examination signal are not detected by the detection unit 218, then, the identification unit 220 may determine that the section of the track that was disposed between the vehicles 202, 204 is broken or otherwise damaged such that the track cannot conduct the examination signal. Additionally or alternatively, the identification unit 220 can examine the signal-to-noise ratio of the signal detected by the detection unit 218 and determine if the section of the route 108 between the vehicles 202, 204 is potentially broken or damaged. For example, the identification unit 220 may identify this section of the route 108 as being broken or damaged if the signal-to-noise ratio of one or more (or at least a designated amount) of the received signals is less than a designated ratio.

The identification unit 220 may include or be communicatively coupled (e.g., by one or more wired and/or wireless connections that allow communication) with a location determining unit that can determine the location of the vehicle 204 and/or vehicle system. For example, the location determining unit may include a GPS unit or other device that can determine where the first vehicle and/or second vehicle are located along the route 108. The distance between the first vehicle 202 and the second vehicle 204 along the length of the vehicle system may be known to the identification unit 220, such as by inputting the distance into the identification unit 220 using one or more input devices and/or via the communication unit 222.

The identification unit 220 can identify which section of the route 108 is potentially damaged based on the location of the first vehicle 202 and/or the second vehicle 204 during transmission of the examination signal through the route 108. For example, the identification unit 220 can identify the section of the route 108 that is within a designated distance of the vehicle system, the first vehicle 202, and/or the second vehicle 204 as the potentially damaged section when the identification unit 220 determines that the examination signal is not received or has a decreased signal-to-noise ratio.

Additionally or alternatively, the identification unit 220 can identify which section of the route 108 is potentially damaged based on the locations of the first vehicle 202 and the second vehicle 204 during transmission of the examination signal through the route 108, the direction of travel of the vehicle system that includes the vehicles 202, 204, the speed of the vehicle system, and/or a speed of propagation of the examination signal through the route 108. The speed of propagation of the examination signal may be a designated speed that is based on one or more of the material(s) from which the route 108 is formed, the type of examination signal that is injected into the route 108, and the like. In an embodiment, the identification unit 220 may be notified when the examination signal is injected into the route 108 via the notification provided by the control unit 206. The identification unit 220 can then determine which portion of the route 108 is disposed between the first vehicle 202 and the second vehicle 204 as the vehicle system moves along the route 108 during the time period that corresponds to when the examination signal is expected to be propagating through the route 108 between the vehicles 202, 204 as the vehicles 202, 204 move. This portion of the route 108 may be the section of potentially damaged route that is identified.

Further, in various embodiments, the identification unit 220 may be configured to identify a type of fault based upon one or more electrical characteristics of a monitored examination signal transmitted through the route 108 and detected by the detection unit 218. In some embodiments, signatures corresponding to particular types of known faults may be recorded over time, and faults corresponding to newly detected signals identified based on the previously identified signatures of known faults. Known signatures corresponding to particular types of faults may be analyzed or studied to identify characteristics or groups or combinations of characteristics of monitored examination signals corresponding to particular faults. Additionally or alternatively, a signal characteristic (e.g., a noise measure) and/or a location of the detected fault (e.g., location relative to a known insulated joint, switch component, or the like) may be used to identify a particular type of fault.

Different types of faults may be distinguished between. (As used herein, distinguishing between two or more particular types of faults may be understood to include individually identifying the two or more particular types of faults.) For example, the identification unit 220 may be configured to distinguish between short circuits. For instance, one type of short may be caused when scrap metal (e.g., metal banding) or other conductive debris is on the track. Another type of short may result when insulation of a switch component fails. In some embodiments, the identification unit 220 may distinguish between the failures based upon a signature of a monitored examination signal. Additionally or alternatively, the location of the fault may be used to determine the type of fault. For example, if the fault occurs at a known location of a switch component, the identification unit 220 may determine the short to be caused by failed insulation of the switch component. On the other hand, if the fault does not occur at a known location of a switch component or other component that may experience defective insulation, the fault may be identified as a short caused by debris on the track. With the cause of the fault or type of fault identified, specifically tailored maintenance actions may be efficiently planned and executed.

Additionally or alternatively, other types of faults may be identified and/or distinguished between. For example, a detected fault may relate to a disruption in transmission of an examination signal through one or more tracks. For example, a broken rail may disrupt transmission of a signal through a track, or an insulated joint may disrupt transmission. In some embodiments, insulated joints and broken rails may be identified and/or distinguished between based on characteristics of a monitored examination signals. Additionally or alternatively, other techniques may be employed. For example, if a similar disruption is observed on each side of a route (e.g., at a same location if tracks are not staggered, or, if the tracks are staggered, at a distance from each other corresponding to a staggered distance of tracks), the disruption may be identified as a pair of functioning insulated joints, and no fault reported. If the disruption occurs at a location known to correspond to an insulated joint (e.g., as saved in a database available or accessible to the vehicle), but is only on a single side of the track, the signal may be determined to correspond to an insulated joint pair for which only one joint is properly functioning, and identified as a faulty individual insulated joint. If the disruption occurs at a location that does not correspond to an insulated joint location, the signal may be identified as corresponding to a broken rail. It may be noted that for any particular identification of a fault discussed herein, additional analysis or investigation may be employed in various embodiments to confirm the identification. Further still, in various embodiments, the identification unit 220 may actively attempt to confirm locations of attributes or components of the route 108 to confirm proper functioning. For example, using a database of known insulated joint (or other feature) locations, the identification unit 220 may monitor examination signals to confirm that the insulated joint (or other feature) is properly functioning. Thus, if the vehicle passes a location of an insulated joint (or other feature) and does not detect an expected disruption in the signal corresponding to an insulated joint (or does not detect a signal signature or characteristic corresponding to the other feature), the identification unit 220 may determine that the insulated joint (or other feature) is not functioning properly.

As one more example, the identification unit 220 may distinguish between a broken bond wire between adjacent rail segments and a broken rail. The identification unit 220 may distinguish between a broken bond wire and a broken rail, for example, based on differences in signature of monitored examination signals between the faults observed or determined previously. The signal corresponding to a broken bond wire, for example, may be quite noisy, or include a recognizable noise measure or metric. Thus, in some embodiments, based on the noise of the corresponding monitored examination signal, the identification unit 220 may determine that a fault is caused by a broken bond wire. Accordingly, the correct personnel and equipment for fixing a broken bond wire (instead of repairing a broken rail) may be alerted of and/or dispatched to the location of the broken bond wire fault. It may be noted that a broken bond wire may not be readily visible to an observer walking the track, and/or may exhibit faulty behavior only when a corresponding section of track is weighed down by a vehicle on the track, with identification by the identification unit 220 thereby saving considerable time that may be spent by a human observer attempting to troubleshoot such a fault.

As discussed herein, for example in connection with FIGS. 12 and 13, the identification unit 220 may also identify faults related to transmission of a track signal into a track by an off-board entity, system, or device, such as a track signaling system. For example, monitored examination signals corresponding to a properly functioning transmitter may be recorded during an installation or calibration of the transmitter. As vehicles pass by the transmitter over time, monitored examination signals corresponding to the transmitter in operation may be collected, recorded, and stored in a log. If the examination signals are observed to degrade beyond a threshold, the transmitter may be identified for repair. Further, if during performance of a mission, a vehicle passes the transmitter and the identification unit 220 determines that the signal is below an acceptable strength threshold or otherwise faulty, the transmitter may be identified as being faulty. Further still, if the signal obtained by the identification unit 220 from the transmitter via the detection unit 218 indicates that the transmitter still functions acceptably but is within a predetermined range of a faulty performance level, the transmitter may be identified for future repair, or for additional observation or testing. Yet further still, a database identifying known transmitter locations may be available to or accessible by the identification unit 220. If the vehicle passes a known transmitter location without a signal corresponding to the transmitter being detected or identified by the identification unit 220, the identification unit 220 may identify the corresponding transmitter as experiencing a fault, and appropriate maintenance personnel may be notified.

One or more responsive actions may be initiated when the potentially damaged section of the route 108 is identified. For example, in response to identifying the potentially damaged portion of the route 108, the identification unit 220 may notify the control unit 206 via the communication units 222, 216. The control unit 206 and/or the identification unit 220 can automatically slow down or stop movement of the vehicle system. For example, the control unit 206 and/or identification unit 220 can be communicatively coupled with one or more propulsion systems (e.g., engines, alternators/ generators, motors, and the like) of one or more of the propulsion-generating vehicles in the vehicle system. The control unit 206 and/or identification unit 220 may automatically direct the propulsion systems to slow down and/or stop.

Additionally or alternatively, the identification unit 220 may provide a notification to an off-board entity 250 via the communication unit 222. The off-board entity 250 may include one or more of a maintenance system, maintenance personnel, dispatching system, dispatching personnel, mobile device, website, or the like. The information provided to the off-board entity 250 may be provided for example, via a web interface. The information provided may include an identification of a particular type and/or cause of fault (e.g., failed insulation, broken rail, broken bond wire, faulty transmitter, or the like), along with the location of the fault. In some embodiments, the information may also include a status or urgency of the fault. For example, a transmitter identified as not transmitting may be identified as a current fault. As another example, a transmitter identified as currently operating within an acceptable range but below a preferred level may be identified as an expected future fault. The off-board entity 250 may identify current faults for immediate repair, and may identify expected future faults for further testing or analysis, or for repair with a lower urgency than a current fault (e.g., maintenance personnel may be dispatched to address a future expected fault only after all current faults are addressed).

Figure 3:
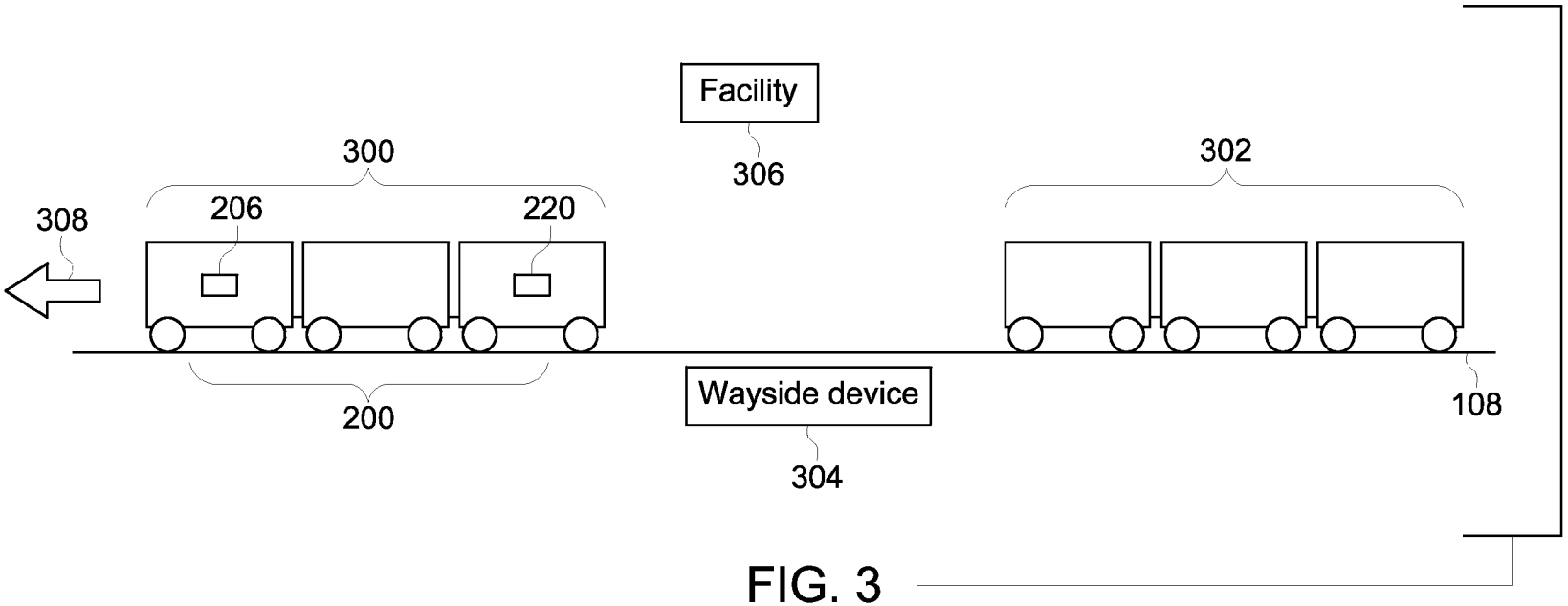
FIG. 3 illustrates a schematic diagram of an embodiment of plural vehicle systems traveling along the route.

With continued reference to FIG. 2, FIG. 3 illustrates a schematic diagram of an embodiment of plural vehicle systems 300, 302 traveling along the route 108. One or more of the vehicle systems 300, 302 may represent the vehicle system 100 shown in FIG. 1 that includes the route examining system 200. For example, at least a first vehicle system 300 traveling along the route 108 in a first direction 308 may include the examining system 200. The second vehicle system 302 may be following the first vehicle system 300 on the route 108, but spaced apart and separated from the first vehicle system 300.

In addition or as an alternate to the responsive actions that may be taken when a potentially damaged section of the route 108 is identified, the examining system 200 onboard the first vehicle system 300 may automatically notify the second vehicle system 302. The control unit 206 and/or the identification unit 220 may wirelessly communicate (e.g., transmit or broadcast) a warning signal to the second vehicle system 302. The warning signal may notify the second vehicle system 302 of the location of the potentially damaged section of the route 108 before the second vehicle system 302 arrives at the potentially damaged section. The second vehicle system 302 may be able to slow down, stop, or move to another route to avoid traveling over the potentially damaged section.

Additionally or alternatively, the control unit 206 and/or identification unit 220 may communicate a warning signal to a stationary wayside device 304 in response to identifying a section of the route 108 as being potentially damaged. The device 304 can be, for instance, wayside equipment, an electrical device, a client asset, a defect detection device, a device utilized with Positive Train Control (PTC), a signal system component(s), a device utilized with Automated Equipment Identification (AEI), among others. In one example, the device 304 can be a device utilized with AEI. AEI is an automated equipment identification mechanism that can aggregate data related to equipment for the vehicle. By way of example and not limitation, AEI can utilize passive radio frequency technology in which a tag (e.g., passive tag) is associated with the vehicle and a reader/receiver receives data from the tag when in geographic proximity thereto. The AEI device can be a reader or receiver that collects or stores data from a passive tag, a data store that stores data related to passive tag information received from a vehicle, an antenna that facilitates communication between the vehicle and a passive tag, among others. Such an AEI device may store an indication of where the potentially damaged section of the route 108 is located so that the second vehicle system 302 may obtain this indication when the second vehicle system 302 reads information from the AEI device.

In another example, the device 304 can be a signaling device for the vehicle. For instance, the device 304 can provide visual and/or audible warnings to provide warning to other entities such as other vehicle systems (e.g., the vehicle system 302) of the potentially damaged section of the route 108. The signaling devices can be, but not limited to, a light, a motorized gate arm (e.g., motorized motion in a vertical plane), an audible warning device, among others.

In another example, the device 304 can be utilized with PTC. PTC can refer to communication-based/processor-based vehicle control technology that provides a system capable of reliably and functionally preventing collisions between vehicle systems, over speed derailments, incursions into established work zone limits, and the movement of a vehicle system through a route switch in the improper position. PTC systems can perform other additional specified functions. Such a PTC device 304 can provide warnings to the second vehicle system 204 that cause the second vehicle system 204 to automatically slow and/or stop, among other responsive actions, when the second vehicle system 204 approaches the location of the potentially damaged section of the route 108.

In another example, the wayside device 304 can act as a beacon or other transmitting or broadcasting device other than a PTC device that communicates warnings to other vehicles or vehicle systems traveling on the route 108 of the identified section of the route 108 that is potentially damaged.

The control unit 206 and/or identification unit 220 may communicate a repair signal to an off-board facility 306 in response to identifying a section of the route 108 as being potentially damaged. The facility 306 can represent a location, such as a dispatch or repair center, that is located off-board of the vehicle systems 202, 204. The repair signal may include or represent a request for further inspection and/or repair of the route 108 at the potentially damaged section. Upon receipt of the repair signal, the facility 306 may dispatch one or more persons and/or equipment to the location of the potentially damaged section of the route 108 in order to inspect and/or repair the route 108 at the location.

Additionally or alternatively, the control unit 206 and/or identification unit 220 may notify an operator of the vehicle system of the potentially damaged section of the route 108 and suggest the operator initiate one or more of the responsive actions described herein.

In another embodiment, the examining system 200 may identify the potentially damaged section of the route 108 using the wayside device 304. For example, the detection device 230, the detection unit 218, and the communication unit 222 may be located at or included in the wayside device 304. The control unit 206 on the vehicle system may determine when the vehicle system is within a designated distance of the wayside device 304 based on an input or known location of the wayside device 304 and the monitored location of the vehicle system (e.g., from data obtained from a location determination unit). Upon traveling within a designated distance of the wayside device 304, the control unit 206 may cause the examination signal to be injected into the route 108. The wayside device 304 can monitor one or more electrical characteristics of the route 108 similar to the second vehicle 204 described above. If the electrical characteristics indicate that the section of the route 108 between the vehicle system and the wayside device 304 is damaged or broken, the wayside device 304 can initiate one or more responsive actions, such as by directing the vehicle system to automatically slow down and/or stop, warning other vehicle systems traveling on the route 108, requesting inspection and/or repair of the potentially damaged section of the route 108, and the like.

Figure 5:
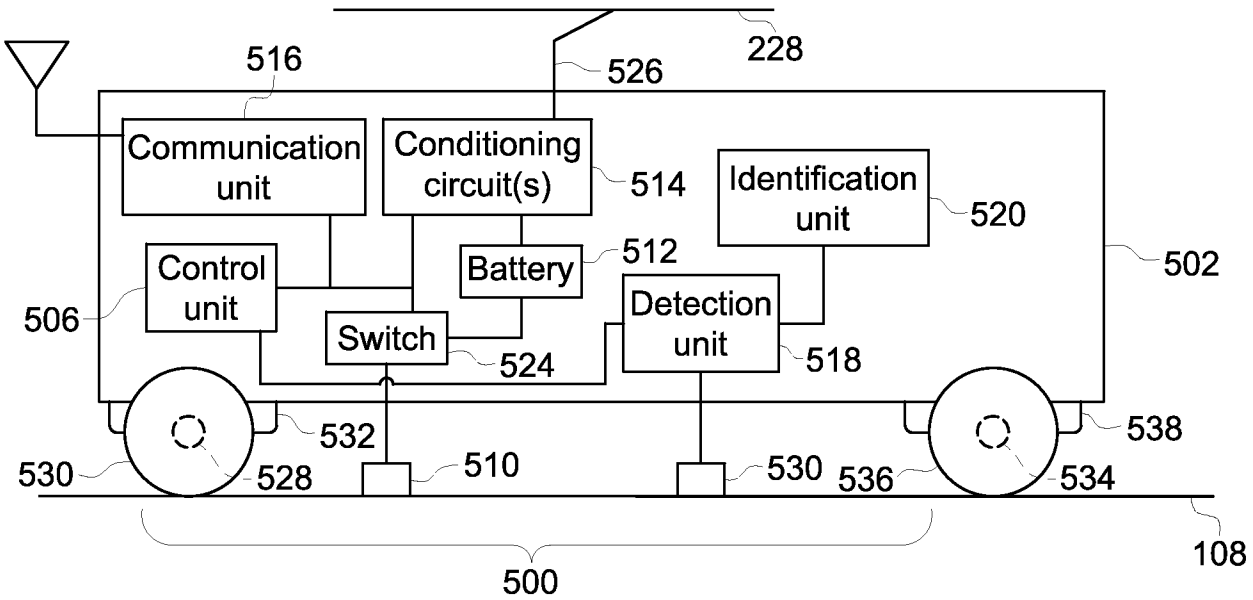
FIG. 5 is a schematic illustration of an embodiment of an examining system.

FIG. 5 is a schematic illustration of an embodiment of an examining system 500. The examining system 500 may represent the examining system 102 shown in FIG. 1. In contrast to the examining system 200 shown in FIG. 2, the examining system 500 is disposed within a single vehicle 502 in a vehicle system that may include one or more additional vehicles mechanically coupled with the vehicle 502. The vehicle 502 may represent a vehicle 104 and/or 106 of the vehicle system 100 shown in FIG. 1. The examining system 500 may include one or more generally similar attributes to those discussed in connection with the examining system 200. For example, the examining system 500 may be configured to identify particular faults and locations of the faults along a route.

The examining system 500 includes several components described below that are disposed onboard the vehicle 502. For example, the illustrated embodiment of the examining system 500 includes a control unit 508 (which may be similar to or represent the control unit 208 shown in FIG. 2), an application device 510 (which may be similar to or represent the application device 210 shown in Figure), an onboard power source 512 ("Battery" in FIG. 5, which may be similar to or represent the power source 212 shown in FIG. 2), one or more conditioning circuits 514 (which may be similar to or represent the circuits 214 shown in FIG. 2), a communication unit 516 (which may be similar to or represent the communication unit 216 shown in FIG. 2), and one or more switches 524 (which may be similar to or represent the switches 224 shown in FIG. 2). The examining system 500 also includes a detection unit 518 (which may be similar to or represent the detection unit 218 shown in FIG. 2), an identification unit 520 (which may be similar to or represent the identification unit 220 shown in FIG. 2), and a detection device 530 (which may be similar to or represent the detection device 230 shown in FIG. 2). As shown in FIG. 5, these components of the examining system 500 are disposed onboard a single vehicle 502 of a vehicle system.

As described above, the control unit 506 controls supply of electric current to the application device 510 that engages or is inductively coupled with the route 108 as the vehicle 502 travels along the route 108. The application device 510 is conductively coupled with the switch 524 that is controlled by the control unit 506 so that the control unit 506 can turn on or off the flow of electric current through the application device 510 to the route 108. The power source 512 is coupled with the switch 524 so that the control unit 506 can control when the electric energy stored in the power source 512 and/or the electric current generated by the power source 512 is conveyed as electric current to the route 108 via the application device 510.

The conditioning circuit 514 may be coupled with a connecting assembly 526 that is similar to or represents the connecting assembly 226 shown in FIG. 2. The connecting assembly 526 receives electric current from an off-board source, such as the electrified conductive pathway 228. Electric current can be conveyed from the electrified portion of the route 108 through the connecting assembly 526 and to the conditioning circuit 514.

The electric current that is conveyed to the conditioning circuit 514 from the power source 512 and/or the off-board source can be altered by the conditioning circuit 514. The modified current can be the examination signal that is electrically injected into the route 108 by the application device 510. Optionally, the control unit 506 can form the examination signal by controlling the switch 524, as described above. Optionally, the control unit 506 may control the conditioning circuit 514 to form the examination signal, also as described above.

The examination signal is conducted through the application device 510 to the route 108, and is electrically injected into a conductive portion of the route 108. The conductive portion of the route 108 that extends between the application device 510 and the detection device 530 of the vehicle 502 during travel may form a track circuit through which the examination signal may be conducted.

The control unit 506 may include or represent a manager component. Such a manager component can be configured to activate a transmission of electric current into the route 108 via the application device 510. In another instance, the manager component can activate or deactivate a transfer of the portion of power from the onboard and/or off-board power source to the application device 510, such as by controlling the switch and/or conditioning circuit. Moreover, the manager component can adjust parameter(s) associated with the portion of power that is transferred to the route 108.

The detection unit 518 monitors the route 108 to attempt to detect the examination signal that is injected into the route 108 by the application device 510. In one aspect, the detection unit 518 may follow behind the application device 510 along a direction of travel of the vehicle 502. The detection unit 518 is coupled with the detection device 530 that engages or is inductively coupled with the route 108, as described above.

The detection unit 518 monitors one or more electrical characteristics of the route 108 using the detection device 530. The detection unit 518 may compare the received signal that is conducted from the route 108 into the detection device 530 with this designated signal in order to measure a signal-to-noise ratio of the received signal. The detection unit 518 determines one or more electrical characteristics of the signal by the detection device 530 from the route 108 and reports the characteristics of the received signal to the identification unit 520. If no signal is received by the detection device 530, then the detection unit 518 may report the absence of such a signal to the identification unit 520. In an embodiment, the detection unit 518 may determine the characteristics of the signals received by the detection device 530 in response to a notification received from the control unit 506, as described above.

The detection unit 518 may begin monitoring signals received by the detection device 530. For example, the detection unit 518 may not begin or resume monitoring the received signals of the detection device 530 unless or until the detection unit 518 is instructed that the control unit 506 is causing the injection of the examination signal into the route 108. Alternatively or additionally, the detection unit 518 may periodically monitor the detection device 530 for received signals and/or may monitor the detection device 530 for received signals upon being manually prompted by an operator of the examining system 500.

In one aspect, the application device 510 includes a first axle 528 and/or a first wheel 530 that is connected to the axle 528 of the vehicle 502. The axle 528 and wheel 530 may be connected to a first truck 532 of the vehicle 502. The application device 510 may be conductively coupled with the route 108 (e.g., by directly engaging the route 108) to inject the examination signal into the route 108 via the axle 528 and the wheel 530, or via the wheel 530 alone. The detection device 530 may include a second axle 534 and/or a second wheel 536 that is connected to the axle 534 of the vehicle 502. The axle 534 and wheel 536 may be connected to a second truck 538 of the vehicle 502. The detection device 530 may monitor the electrical characteristics of the route 108 via the axle 534 and the wheel 536, or via the wheel 536 alone. Optionally, the axle 534 and/or wheel 536 may inject the signal while the other axle 528 and/or wheel 530 monitors the electrical characteristics.

The identification unit 520 receives the characteristics of the received signal from the detection unit 518 and determines if the characteristics indicate receipt of all or a portion of the examination signal injected into the route 108 by the application device 510. The identification unit 520 examines the characteristics and determines if the characteristics indicate that the section of the route 108 disposed between the application device 510 and the detection device 530 is damaged or at least partially damaged, as described above.

The identification unit 520 may include or be communicatively coupled with a location determining unit that can determine the location of the vehicle 502. The distance between the application device 510 and the detection device 530 along the length of the vehicle 502 may be known to the identification unit 520, such as by inputting the distance into the identification unit 520 using one or more input devices and/or via the communication unit 516.

The identification unit 520 can identify which section of the route 108 is potentially damaged based on the location of the vehicle 502 during transmission of the examination signal through the route 108, the direction of travel of the vehicle 502, the speed of the vehicle 502, and/or a speed of propagation of the examination signal through the route 108, as described above.

One or more responsive actions may be initiated when the potentially damaged section of the route 108 is identified. For example, in response to identifying the potentially damaged portion of the route 108, the identification unit 520 may notify the control unit 506. The control unit 506 and/or the identification unit 520 can automatically slow down or stop movement of the vehicle 502 and/or the vehicle system that includes the vehicle 502. For example, the control unit 506 and/or identification unit 520 can be communicatively coupled with one or more propulsion systems (e.g., engines, alternators/generators, motors, and the like) of one or more of the propulsion-generating vehicles in the vehicle system. The control unit 506 and/or identification unit 520 may automatically direct the propulsion systems to slow down and/or stop.

Figure 4:
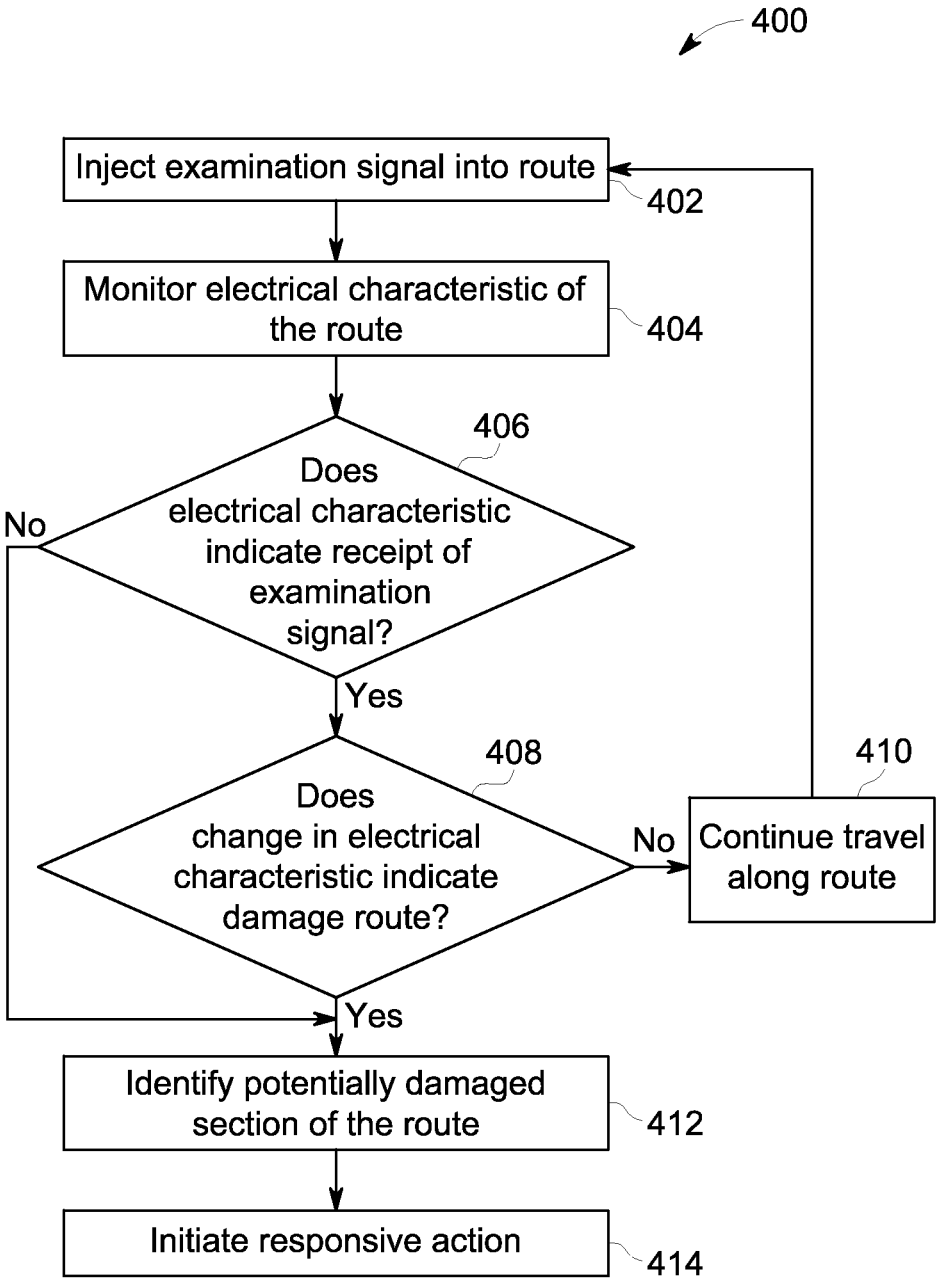
FIG. 4 is a flowchart of an embodiment of a method for examining a route being traveled by a vehicle system from onboard the vehicle system.

FIG. 4 is a flowchart of an embodiment of a method 400 for examining a route being traveled by a vehicle system from onboard the vehicle system. The method 400 may be used in conjunction with one or more embodiments of the vehicle systems and/or examining systems described herein. Alternatively, the method 400 may be implemented with another system.

At 402, an examination signal is injected into the route being traveled by the vehicle system at a first vehicle. For example, a direct current, alternating current, RF signal, or another signal may be conductively and/or inductively injected into a conductive portion of the route 108, such as a track of the route 108.

At 404, one or more electrical characteristics of the route are monitored at another, second vehicle in the same vehicle system. For example, the route 108 may be monitored to determine if any voltage or current is being conducted by the route 108.

At 406, a determination is made as to whether the one or more monitored electrical characteristics indicate receipt of the examination signal. For example, if a direct current, alternating current, or RF signal is detected in the route 108, then the detected current or signal may indicate that the examination signal is conducted through the route 108 from the first vehicle to the second vehicle in the same vehicle system. As a result, the route 108 may be substantially intact between the first and second vehicles. Optionally, the examination signal may be conducted through the route 108 between components joined to the same vehicle. As a result, the route 108 may be substantially intact between the components of the same vehicle. Flow of the method 400 may proceed to 408. On the other hand, if no direct current, alternating current, or RF signal is detected in the route 108, then the absence of the current or signal may indicate that the examination signal is not conducted through the route 108 from the first vehicle to the second vehicle in the same vehicle system or between components of the same vehicle. As a result, the route 108 may be broken between the first and second vehicles, or between the components of the same vehicle. Flow of the method 400 may then proceed to 412.

At 408, a determination is made as to whether a change in the one or more monitored electrical characteristics indicates damage to the route. For example, a change in the examination signal between when the signal was injected into the route 108 and when the examination signal is detected may be determined. This change may reflect a decrease in voltage, a decrease in amps, a change in frequency and/or phase, a decrease in a signal-to-noise ratio, or the like. The change can indicate that the examination signal was conducted through the route 108, but that damage to the route 108 may have altered the signal. For example, if the change in voltage, amps, frequency, phase, signal-to-noise ratio, or the like, of the injected examination signal to the detected examination signal exceeds a designated threshold amount (or if the monitored characteristic decreased below a designated threshold), then the change may indicate damage to the route 108, but not a complete break in the route 108. As a result, flow of the method 400 can proceed to 412.

On the other hand, if the change in voltage, amps, frequency, phase, signal-to-noise ratio, or the like, of the injected examination signal to the detected examination signal does not exceed the designated threshold amount (and/or if the monitored characteristic does not decrease below a designated threshold), then the change may not indicate damage to the route 108. As a result, flow of the method 400 can proceed to 410.

At 410, the section of the route that is between the first and second vehicles in the vehicle system or between the components of the same vehicle is not identified as potentially damaged, and the vehicle system may continue to travel along the route. Additionally examination signals may be injected into the route at other locations as the vehicle system moves along the route.

At 412, the section of the route that is or was disposed between the first and second vehicles, or between the components of the same vehicle, is identified as a potentially damaged section of the route. For example, due to the failure of the examination signal to be detected and/or the change in the examination signal that is detected, the route may be broken and/or damaged between the first vehicle and the second vehicle, or between the components of the same vehicle.

At 414, one or more responsive actions may be initiated in response to identifying the potentially damaged section of the route. As described above, these actions can include, but are not limited to, automatically and/or manually slowing or stopping movement of the vehicle system, warning other vehicle systems about the potentially damaged section of the route, notifying wayside devices of the potentially damaged section of the route, requesting inspection and/or repair of the potentially damaged section of the route, and the like.

In one or more embodiments, a route examining system and method may be used to identify short circuits on a route. The identification of short circuits may allow for the differentiation of a short circuit on a non-damaged section of the route from a broken rail on a damaged section of the route. The differentiation of short circuits from open circuits caused by various types of damage to the route provides identification of false alarms. Detecting a false alarm preserves the time and costs associated with attempting to locate and repair a section of the route that is not actually damaged.

Figure 6:
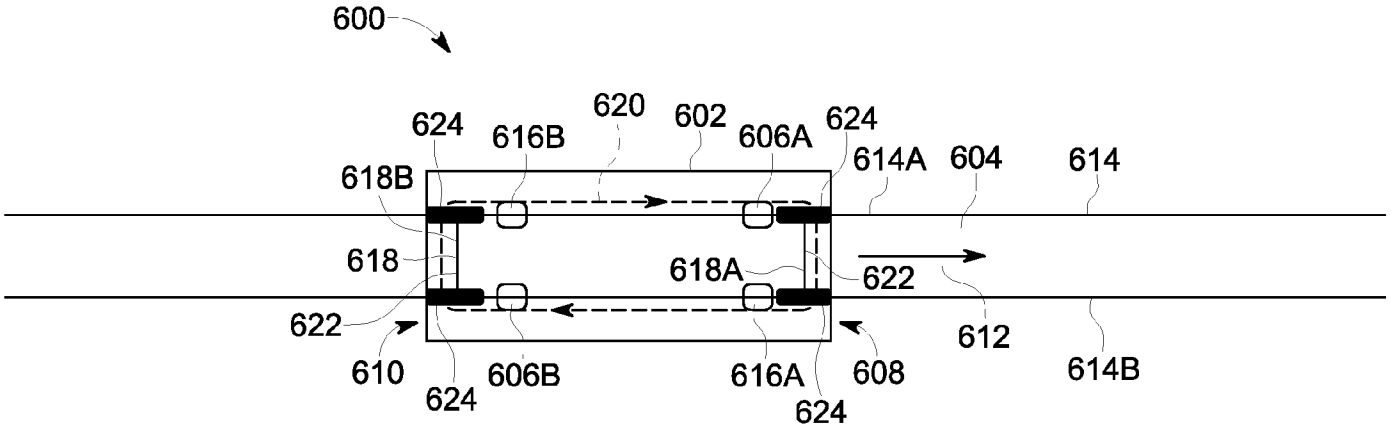
FIG. 6 is a schematic illustration of an embodiment of an examining system on a vehicle of a vehicle system traveling along a route.

FIG. 6 is a schematic illustration of an embodiment of an examining system 600 on a vehicle 602 of a vehicle system (not shown) traveling along a route 604. The examining system 600 may represent the examining system 102 shown in FIG. 1 and/or the examining system 200 shown in FIG. 2. In contrast to the examining system 200, the examining system 600 is disposed within a single vehicle 602. The vehicle 602 may represent at least one of the vehicles 104, 106 shown in FIG. 1. FIG. 6 may be a top-down view looking at least partially through the vehicle 602. The examining system 600 may be utilized to identify short circuits on a route, such as a railway track, for example. The vehicle 602 may be one of multiple vehicles of the vehicle system 602, so the vehicle 602 may be referred to herein as a first vehicle 602.

The vehicle 602 includes multiple transmitters or application devices 606 disposed onboard the vehicle 602. The application devices 606 may be positioned at spaced apart locations along the length of the vehicle 602. For example, a first application device 606A may be located closer to a front end 608 of the vehicle 602 relative to a second application device 606B located closer to a rear end 610 of the vehicle 602. The designations of "front" and "rear" may be based on the direction of travel 612 of the vehicle 602 along the route 604.

The route 604 includes conductive tracks 614 in parallel, and the application devices 606 are configured to be conductively and/or inductively coupled with at least one conductive track 614 along the route 604. For example, the conductive tracks 614 may be rails in a railway context. In an embodiment, the first application device 606A is configured to be conductively and/or inductively coupled with a first conductive track 614A, and the second application device 606B is configured to be conductively and/or inductively coupled with a second conductive track 614B. As such, the application devices 606 may be disposed on the vehicle 602 diagonally from each other. The application devices 606 are utilized to electrically inject at least one examination signal into the route. For example, the first application device 606A may be used to inject a first examination signal into the first conductive track 614A of the route 604. Likewise, the second application device 606B may be used to inject a second examination signal into the second conductive track 614B of the route 604.

The vehicle 602 also includes multiple receiver coils or detection units 616 disposed onboard the vehicle 602. The detection units 616 are positioned at spaced apart locations along the length of the vehicle 602. For example, a first detection unit 616A may be located towards the front end 608 of the vehicle 602 relative to a second detection unit 616B located closer to the rear end 610 of the vehicle 602. The detection units 616 are configured to monitor one or more electrical characteristics of the route 604 along the conductive tracks 614 in response to the examination signals being injected into the route 604. The electrical characteristics that are monitored may include an amplitude of a current, a phase shift, a modulation, a frequency, a voltage, an impedance, and the like. For example, the first detection unit 616A may be configured to monitor one or more electrical characteristics of the route 604 along the second track 614B, and the second detection unit 616B may be configured to monitor one or more electrical characteristics of the route 604 along the first track 614A. As such, the detection units 616 may be disposed on the vehicle 602 diagonally from each other. In an embodiment, each of the application devices 606A, 606B and the detection units 616A, 616B may define individual corners of a test section of the vehicle 602. Optionally, the application devices 606 and/or the detection units 616 may be staggered in location along the length and/or width of the vehicle 602. Optionally, the application device 606A and detection unit 616A and/or the application device 606B and detection unit 616B may be disposed along the same track 614. The application devices 606 and/or detection units 616 may be disposed on the vehicle 602 at other locations in other embodiments.

In an embodiment, two of the conductive tracks 614 (e.g., tracks 614A and 614B) may be conductively and/or inductively coupled to each other through multiple shunts 618 along the length of the vehicle 602. For example, the vehicle 602 may include two shunts 618, with one shunt 618A located closer to the front 608 of the vehicle 602 relative to the other shunt 618B. In an embodiment, the shunts 618 are conductive and together with the tracks 614 define an electrically conductive test loop 620. The conductive test loop 620 represents a track circuit or circuit path along the conductive tracks 614 between the shunts 618. The test loop 620 moves along the tracks 614 as the vehicle 602 travels along the route 604 in the direction 612. Therefore, the section of the conductive tracks 614 defining part of the conductive test loop 620 changes as the vehicle 602 progresses on a trip along the route 604.

In an embodiment, the application devices 606 and the detection units 616 are in electrical contact with the conductive test loop 620. For example, the application device 606A may be in electrical contact with track 614A and/or shunt 618A; the application device 606B may be in electrical contact with track 614B and/or shunt 618B; the detection unit 616A may be in electrical contact with track 614B and/or shunt 618A; and the detection unit 616B may be in electrical contact with track 614A and/or shunt 618B.

The two shunts 618A, 618B may be first and second trucks disposed on a rail vehicle. Each truck 618 includes an axle 622 interconnecting two wheels 624. Each wheel 624 contacts a respective one of the tracks 614. The wheels 624 and the axle 622 of each of the trucks 618 are configured to electrically connect (e.g., short) the two tracks 614A, 614B to define respective ends of the conductive test loop 620. For example, the injected first and second examination signals may circulate the conductive test loop 620 along the length of a section of the first track 614A, through the wheels 624 and axle 622 of the shunt 618A to the second track 614B, along a section of the second track 614B, and across the shunt 618B, returning to the first track 614A.

In an embodiment, alternating current transmitted from the vehicle 602 is injected into the route 604 at two or more points through the tracks 614 and received at different locations on the vehicle 602. For example, the first and second application devices 606A, 606B may be used to inject the first and second examination signals into respective first and second tracks 614A, 614B. One or more electrical characteristics in response to the injected examination signals may be received at the first and second detection units 616A, 616B. Each examination signal may have a unique identifier so the signals can be distinguished from each other at the detection units 616. For example, the unique identifier of the first examination signal may have a base frequency, a modulation, an embedded signature, and/or the like, that differs from the unique identifier of the second examination signal.

In an embodiment, the examining system 600 may be used to more precisely locate faults on track circuits in railway signaling systems, and to differentiate between track features. For example, the system 600 may be used to distinguish broken tracks (e.g., rails) versus crossing shunt devices, non-insulated switches, scrap metal connected across the tracks 614A and 614B, and other situations or devices that might produce an electrical short (e.g., short circuit) when a current is applied to the conductive tracks 614 along the route 604. In typical track circuits looking for damaged sections of routes, an electrical short may appear as similar to a break, creating a false alarm. The examining system 600 also may be configured to distinguish breaks in the route due to damage from intentional, non-damaged "breaks" in the route, such as insulated joints and turnouts (e.g., track switches), which simulate actual breaks but do not short the conductive test section 620 when traversed by a vehicle system having the examining system 600.

In an embodiment, when there is no break or short circuit on the route 604 and the tracks 614 are electrically contiguous, the injected examination signals circulate the length of the test section 620 and are received by all detection units 616 present on the test section 620. Therefore, both detection units 616A and 616B receive both the first and second examination signals when there is no electrical break or electrical short on the route 604 within the section of the route 604 defining the test loop 620.

As discussed further below, when the vehicle 602 passes over an electrical short (e.g., a device or a condition of a section of the route 604 that causes a short circuit when a current is applied along the section of the route 604), two additional conductive current loops or conductive short loops are formed. The two additional conductive short loops have electrical characteristics that are unique to a short circuit (e.g., as opposed to electrical characteristics of an open circuit caused by a break in a track 614). For example, the electrical characteristics of the current circulating the first conductive short loop may have an amplitude that is an inverse derivative of the amplitude of the second additional current loop as the electrical short is traversed by the vehicle 602. In addition, the amplitude of the current along the original conductive test loop spanning the periphery of the test section 620 diminishes considerably while the vehicle 602 traverses the electrical short. All of the one or more electrical characteristics in the original and additional current loops may be received and/or monitored by the detection units 616. Sensing the two additional short loops may provide a clear differentiator to identify that the loss of current in the original test loop is the result of a short circuit and not an electrical break in the track 614. Analysis of the electrical characteristics of the additional short loops relative to the vehicle motion and/or location may provide more precision in locating the short circuit within the span of the test section 620.

Figure 7:
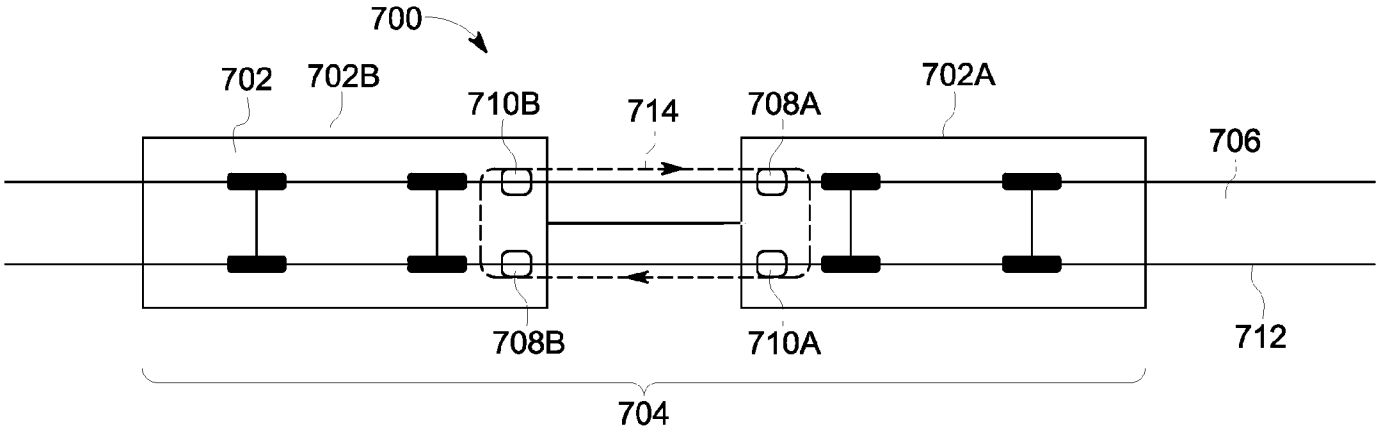
FIG. 7 is a schematic illustration of an embodiment of an examining system disposed on multiple vehicles of a vehicle system traveling along a route.

FIG. 7 is a schematic illustration of an embodiment of an examining system 700 disposed on multiple vehicles 702 of a vehicle system 704 traveling along a route 706. The examining system 700 may represent the examining system 600 shown in FIG. 6. In contrast to the examining system 600 shown in FIG. 6, the examining system 700 is disposed on multiple vehicles 702 in the vehicle system 704, where the vehicles 702 are mechanically coupled together.

In an embodiment, the examining system 700 includes a first application device 708A configured to be disposed on a first vehicle 702A of the vehicle system 702, and a second application device 708B configured to be disposed on a second vehicle 702B of the vehicle system 702. The application devices 708A, 708B may be conductively and/or inductively coupled with different conductive tracks 712, such that the application devices 708A, 708B are disposed diagonally along the vehicle system 704. The first and second vehicles 702A and 702B may be directly coupled, or may be indirectly coupled, having one or more additional vehicles coupled in between the vehicles 702A, 702B. Optionally the vehicles 702A, 702B may each be either one of the vehicles 104 or 106 shown in FIG. 1. Optionally, the second vehicle 702B may trail the first vehicle 702A during travel of the vehicle system 704 along the route 706.

The examining system 700 also includes a first detection unit 710A configured to be disposed on the first vehicle 702A of the vehicle system 702, and a second detection unit 710B configured to be disposed on the second vehicle 702B of the vehicle system 702. The first and second detection units 710A, 710B may be configured to monitor electrical characteristics of the route 706 along different conductive tracks 712, such that the detection units 710 are oriented diagonally along the vehicle system 704. The location of the first application device 708A and/or first detection unit 710A along the length of the first vehicle 702A is optional, as well as the location of the second application device 708B and/or second detection unit 710B along the length of the second vehicle 702B. However, the location of the application devices 708A, 708B affects the length of a current loop that defines a test section 714. Increasing the length of the test section 714 may increase the amount of signal loss as the electrical examination signals are diverted along alternative conductive paths, which diminishes the capability of the detection units 710 to receive the electrical characteristics. Optionally, the application devices 708 and detection units 710 may be disposed on adjacent vehicles 702 and proximate to the coupling mechanism that couples the adjacent vehicles, such that the defined conductive test section 714 may be smaller in length than the conductive test section 620 disposed on the single vehicle 602 (shown in FIG. 6). In some embodiments, one or more additional rails not contacted by the wheels may be employed for use with the application devices and/or detection units.

Figure 8:
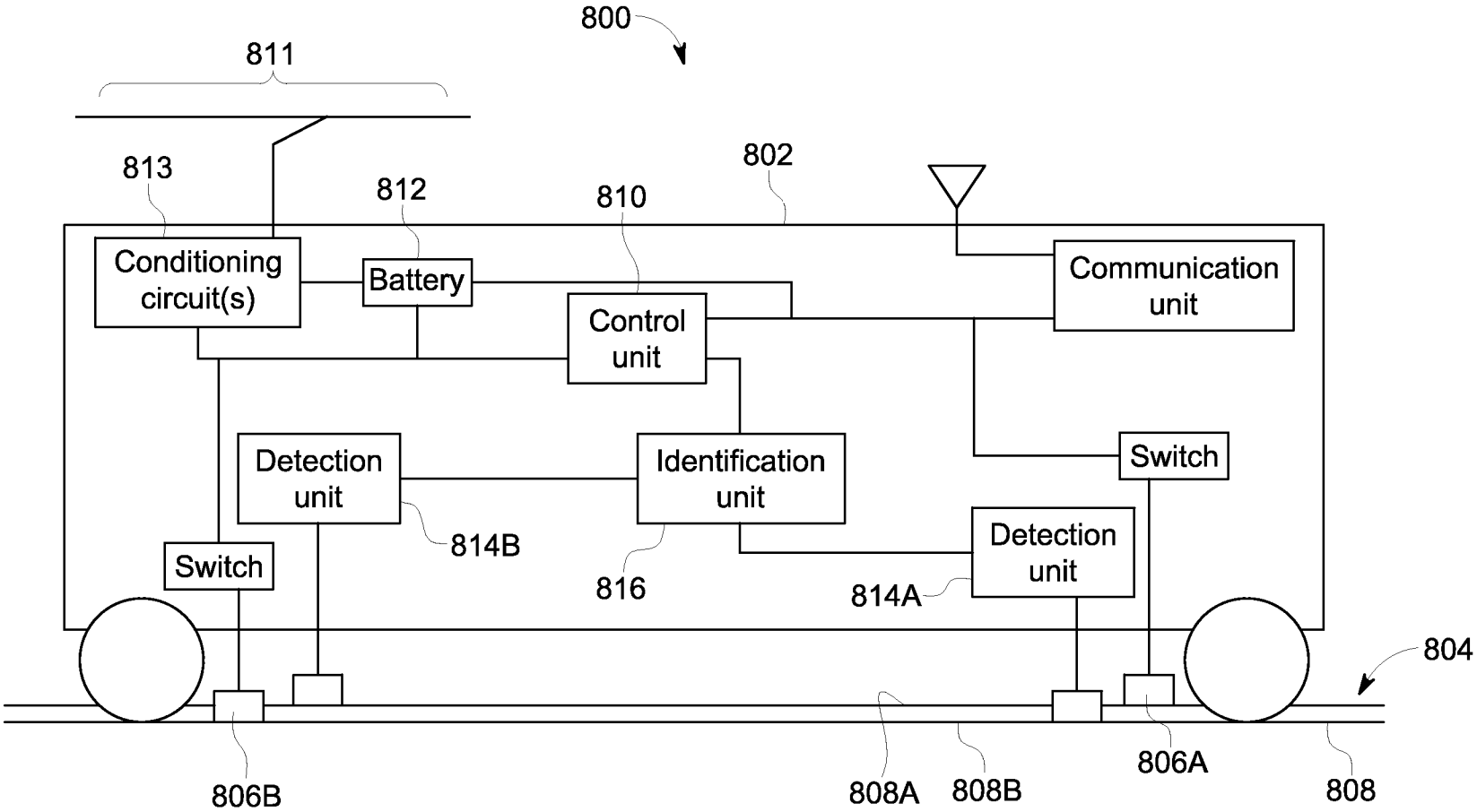
FIG. 8 is a schematic diagram of an embodiment of an examining system on a vehicle of a vehicle system on a route.

FIG. 8 is a schematic diagram of an embodiment of an examining system 800 on a vehicle 802 of a vehicle system (not shown) on a route 804. The examining system 800 may represent the examining system 102 shown in FIG. 1 and/or the examining system 200 shown in FIG. 2. In contrast to the examining system 200, the examining system 800 is disposed within a single vehicle 802. The vehicle 802 may represent at least one of the vehicles 104, 106 shown in FIG. 1.

The vehicle 802 includes a first application device 806A that is conductively and/or inductively coupled to a first conductive track 808A of the route 804, and a second application device 806B that is conductively and/or inductively coupled to a second conductive track 808B. A control unit 810 is configured to control supply of electric current from a power source 811 (e.g., battery 812 and/or conditioning circuits 813) to the first and second application devices 806A, 806B in order to electrically inject examination signals into the conductive tracks 808. For example, the control unit 810 may control the application of a first examination signal into the first conductive track 808A via the first application device 806A and the application of a second examination signal into the second conductive track 808B via the second application device 806B.

The control unit 810 is configured to control application of at least one of a designated direct current, a designated alternating current, or a designated radio frequency signal of each of the first and second examination signals from the power source 811 to the conductive tracks 808 of the route 804. For example, the power source 811 may be an onboard energy storage device 812 (e.g., battery) and the control unit 810 may be configured to inject the first and second examination signals into the route 804 by controlling when electric current is conducted from the onboard energy storage device 812 to the first and second application devices 806A and 806B. Alternatively or in addition, the power source 811 may be an off-board energy storage device 813 (e.g., catenary and conditioning circuits) and the control unit 810 is configured to inject the first and second examination signals into the conductive tracks 808 by controlling when electric current is conducted from the off-board energy storage device 813 to the first and second application devices 806A and 806B.

The vehicle 802 also includes a first detection unit 814A disposed onboard the vehicle 802 that is configured to monitor one or more electrical characteristics of the second conductive track 808B of the route 804, and a second detection unit 814B disposed onboard the vehicle 802 that is configured to monitor one or more electrical characteristics of the first conductive track 808A. An identification unit 816 is disposed onboard the vehicle 802. The identification unit 816 is configured to examine the one or more electrical characteristics of the conductive tracks 808 monitored by the detection units 814A, 814B in order to determine whether a section of the route 804 traversed by the vehicle 802 is potentially damaged based on the one or more electrical characteristics. As used herein, "potentially damaged" means that the section of the route may be damaged, or alternatively, the section may be non-damaged but includes an electrical short. The identification unit 816 may further determine whether the section of the route traversed by the vehicle is damaged by distinguishing between one or more electrical characteristics that indicate damage to the section of the route and one or more electrical characteristics that indicate an electrical short on the section of the route.

Figure 9A:
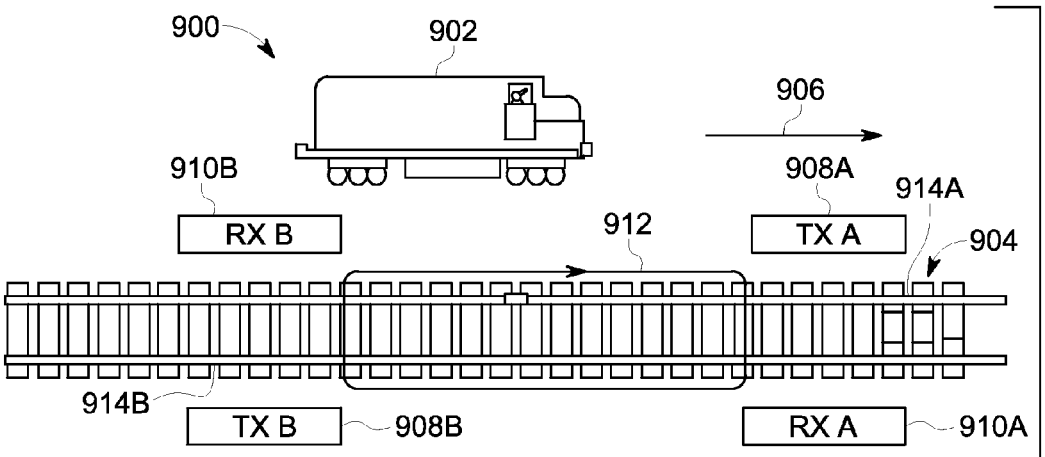
FIGS. 9A, 9B, and 9C are schematic illustrations of embodiments of an examining system on a vehicle as the vehicle travels along a route.
Figure 9B:
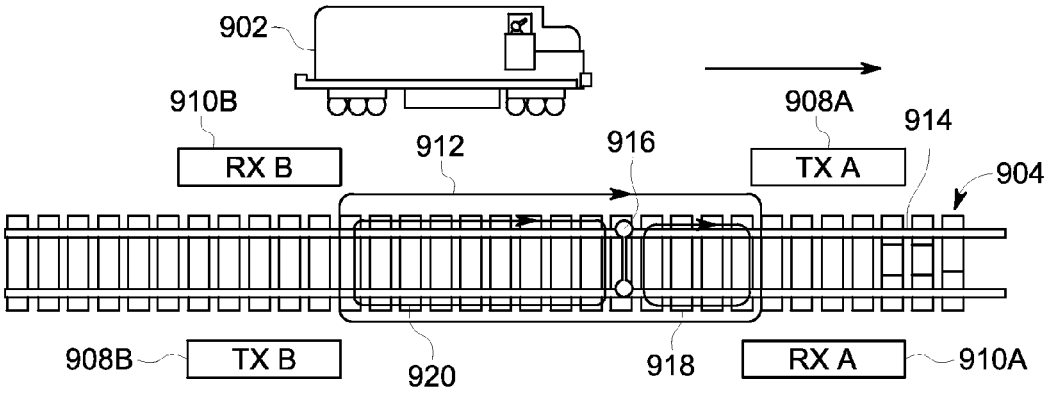
Figure 9C:
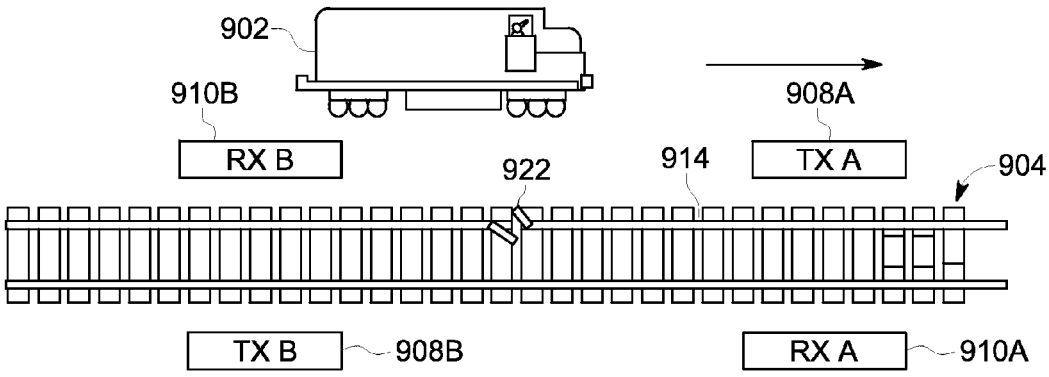

FIGS. 9A, 9B, and 9C are schematic illustrations of an embodiment of an examining system 900 on a vehicle 902 as the vehicle 902 travels along a route 904. The examining system 900 may be the examining system 600 shown in FIG. 6 and/or the examining system 800 shown in FIG. 8. The vehicle 902 may be the vehicle 602 of FIG. 6 and/or the vehicle 802 of FIG. 8. FIGS. 9A-9C illustrate various route conditions that the vehicle 902 may encounter while traversing in a travel direction 906 along the route 904.

The vehicle 902 includes two transmitters or application units 908A and 908B, and two receivers or detection units 910A and 910B all disposed onboard the vehicle 902. The application units 908 and detection units 910 are positioned along a conductive loop 912 defined by shunts on the vehicle 902 and tracks 914 of the route 904 between the shunts. For example, the vehicle 902 may include six axles, each axle attached to two wheels in electrical contact with the tracks 914 and forming a shunt. Optionally, the conductive loop 912 may be bounded between the inner most axles (e.g., between the third and fourth axles) to reduce the amount of signal loss through the other axles and/or the vehicle frame. As such, the third and fourth axles define the ends of the conductive loop 912, and the tracks 914 define the segments of the conductive loop 912 that connect the ends.

The conductive loop 912 defines a test loop 912 (e.g., test section) for detecting faults in the route 904 and distinguishing damaged tracks 914 from short circuit false alarms. As the vehicle 902 traverses the route 904, a first examination signal is injected into a first track 914A of the route 904 from the first application unit 908A, and a second examination signal is injected into a second track 914B of the route 904 from the second application unit 908B. The first and second examination signals may be injected into the route 904 simultaneously or in a staggered sequence. The first and second examination signals each have a unique identifier to distinguish the first examination signal from the second examination signal as the signals circulate the test loop 912. The unique identifier of the first examination signal may include a frequency, a modulation, an embedded signature, and/or the like, that differs from the unique identifier of the second examination signal. For example, the first examination signal may have a higher frequency and/or a different embedded signature than the second examination signal.

In FIG. 9A, the vehicle 902 traverses over a section of the route 904 that is intact (e.g., not damaged) and does not have an electrical short. Since there is no electrical short or electrical break on the route 904 within the area of the conductive test loop 912, which is the area between two designated shunts (e.g., axles) of the vehicle 902, the first and second examination signals both circulate a full length of the test loop 912. As such, the first examination signal current transmitted by the first application device 908A is detected by both the first detection device 910A and the second detection device 910B as the first examination signal current flows around the test loop 912. Although the second examination signal is injected into the route 904 at a different location, the second examination signal current circulates the test loop 912 with the first examination signal current, and is likewise detected by both detection devices 910A, 910B. Each of the detection devices 910A, 910B may be configured to detect one or more electrical characteristics along the route 904 proximate to the respective detection device 910. Therefore, when the section of route is free of shorts and breaks, the electrical characteristics received by each of the detection devices 910 includes the unique signatures of each of the first and second examination signals.

In FIG. 9B, the vehicle 902 traverses over a section of the route 904 that includes an electrical short 916. The electrical short 916 may be a device on the route 904 or condition of the route 904 that conductively and/or inductively couples the first conductive track 914A to the second conductive track 914B. The electrical short 916 causes current injected in one track 914 to flow through the short 916 to the other track 914 instead of flowing along the full length of the conductive test loop 912 and crossing between the tracks 914 at the shunts. For example, the short 916 may be a piece of scrap metal or other extraneous conductive device positioned across the tracks 914, a non-insulated signal crossing or switch, an insulated switch or joint in the tracks 914 that is non-insulated due to wear or damage, and the like. As the vehicle 902 traverses along route 904 over the electrical short 916, such that the short 916 is at least temporarily located between the shunts within the area defined by the test loop 912, the test loop 912 may short circuit.

As the vehicle 902 traverses over the electrical short 916, the electrical short 916 diverts the current flow of the first and second examination signals that circulate the test loop 912 to additional loops. For example, the first examination signal may be diverted by the short 916 to circulate primarily along a first conductive short loop 918 that is newly-defined along a section of the route 904 between the first application device 908A and the electrical short 916. Similarly, the second examination signal may be diverted to circulate primarily along a second conductive short loop 920 that is newly-defined along a section of the route 904 between the electrical short 916 and the second application device 908B. Only the first examining signal that was transmitted by the first application device 908A significantly traverses the first short loop 918, and only the second examination signal that was transmitted by the second application device 908B significantly traverses the second short loop 920.

As a result, the one or more electrical characteristics of the route received and/or monitored by first detection unit 910A may only indicate a presence of the first examination signal. Likewise, the electrical characteristics of the route received and/or monitored by second detection unit 910B may only indicate a presence of the second examining signal. As used herein, "indicat[ing] a presence of" an examination signal means that the received electrical characteristics include more than a mere threshold signal-to-noise ratio of the unique identifier indicative of the respective examination signal that is more than electrical noise. For example, since the electrical characteristics received by the second detection unit 910B may only indicate a presence of the second examination signal, the second examination signal exceeds the threshold signal-to-noise ratio of the received electrical characteristics but the first examination signal does not exceed the threshold. The first examination signal may not be significantly received at the second detection unit 908B because the majority of the first examination signal current originating at the device 908A may get diverted along the short 916 (e.g., along the first short loop 918) before traversing the length of the test loop 912 to the second detection device 908B. As such, the electrical characteristics with the unique identifiers indicative of the first examination signal received at the second detection device 910B may be significantly diminished when the vehicle 902 traverses the electrical short 916.

The peripheral size and/or area of the first and second conductive short loops 918 and 920 may have an inverse correlation at the vehicle 902 traverses the electrical short 916. For example, the first short loop 918 increases in size while the second short loop 920 decreases in size as the test loop 912 of the vehicle 902 overcomes and passes the short 916. It is noted that the first and second short loops 916 are only formed when the short 916 is located within the boundaries or area covered by the test loop 912. Therefore, received electrical characteristics that indicate the examination signals are circulating the first and second conductive short 918, 920 loops signify that the section includes an electrical short 916 (e.g., as opposed to a section that is damaged or is fully intact without an electrical short).

In FIG. 9C, the vehicle 902 traverses over a section of the route 904 that includes an electrical break 922. The electrical break 922 may be damage to one or both tracks 914A, 914B that cuts off (e.g., or significantly reduces) the electrical conductive path along the tracks 914. The damage may be a broken track, disconnected lengths of track, and the like. As such, when a section of the route 904 includes an electrical break, the section of the route forms an open circuit, and current generally does not flow along an open circuit. In some breaks, it may be possible for inductive current to traverse slight breaks, but the amount of current would be greatly reduced as opposed to a non-broken conductive section of the route 904.

As the vehicle 902 traverses over the electrical break 922 such that the break 922 is located within the boundaries of the test loop 912 (e.g., between designated shunts of the vehicle 902 that define the ends of the test loop 912), the test loop 912 may be broken, forming an open circuit. As such, the injected first and second examination signals do not circulate the test loop 912 nor along any short loops. The first and second detection units 910A and 910B do not receive any significant electrical characteristics in response to the first and second examination signals because the signal current do not flow along the broken test loop 912. Once, the vehicle 902 passes beyond the break, subsequently injected first and second examination signals may circulate the test section 912 as shown in FIG. 9A. It is noted that the vehicle 902 may traverse an electrical break caused by damage to the route 904 without derailing. Some breaks may support vehicular traffic for an amount of time until the damage increases beyond a threshold, as is known in the art.

As shown in FIGS. 9A-C, the electrical characteristics along the route 904 that are detected by the detection units 910 may differ whether the vehicle 902 traverses over a section of the route 904 having an electrical short 916 (shown in FIG. 9B), an electrical break 922 (shown in FIG. 9C), or is electrically contiguous (shown in FIG. 9A). The examining system 900 may be configured to distinguish between one or more electrical characteristics that indicate a damaged section of the route 904 and one or more electrical characteristics that indicate a non-damaged section of the route 904 having an electrical short 916, as discussed further herein.

Figure 10:
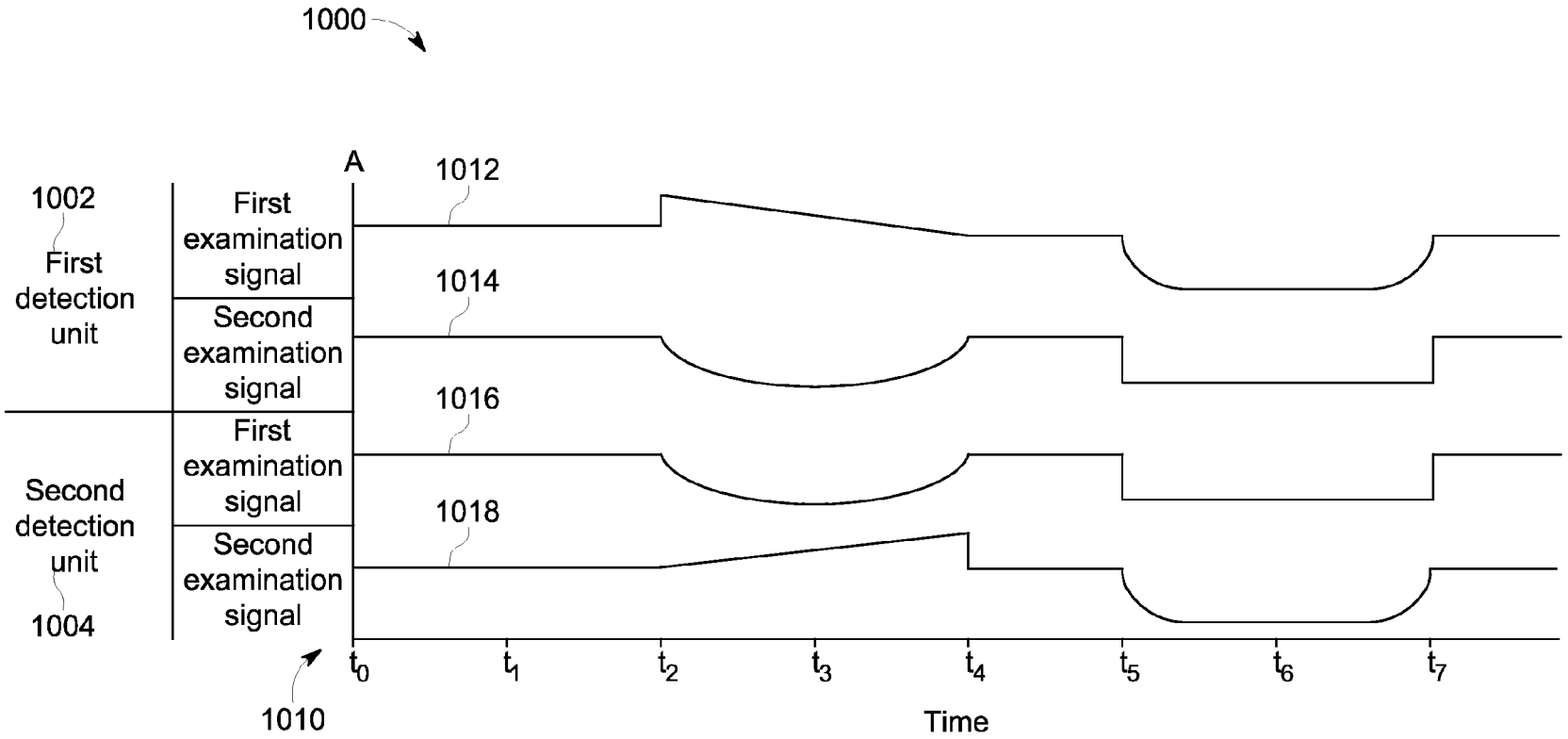
FIG. 10 illustrates electrical signals monitored by an examining system on a vehicle system as the vehicle system travels along a route.

FIG. 10 illustrates electrical signals 1000 monitored by an examining system on a vehicle system as the vehicle system travels along a route. The examining system may be the examining system 900 shown in FIGS. 9A-9C. The vehicle system may include vehicle 902 traveling along the route 904 (both shown in FIGS. 9A-9C). The electrical signals 1000 are one or more electrical characteristics that are received by a first detection unit 1002 and a second detection unit 1004. The electrical signals 1000 are received in response to the transmission or injection of a first examination signal and a second examination signal into the route. The first and second examination signals may each include a unique identifier that allows the examining system to distinguish electrical characteristics of a monitored current that are indicative of the first examination signal from electrical characteristics indicative of the second examination signal, even if an electrical current includes both examination signals.

In FIG. 10, the electrical signals 1000 are graphically displayed on a graph 1010 plotting amplitude (A) of the signals 1000 over time (t). For example, the graph 1010 may graphically illustrate the monitored electrical characteristics in response to the first and second examination signals while the vehicle 902 travels along the route 904 and encounters the various route conditions described with reference to FIGS. 9A-9C. The graph 1010 may be displayed on a display device for an operator onboard the vehicle and/or may be transmitted to an off-board location such as a dispatch or repair facility. The first electrical signal 1012 represents the electrical characteristics in response to (e.g., indicative of) the first examination signal that are received by the first detection unit 1002. The second electrical signal 1014 represents the electrical characteristics in response to (e.g., indicative of) the second examination signal that are received by the first detection unit 1002. The third electrical signal 1016 represents the electrical characteristics in response to (e.g., indicative of) the first examination signal that are received by the second detection unit 1004. The fourth electrical signal 1018 represents the electrical characteristics in response to (e.g., indicative of) the second examination signal that are received by the second detection unit 1004.

Between times t0 and t2, the electrical signals 1000 indicate that both examination signals are being received by both detection units 1002, 1004. Therefore, the signals are circulating the length of the conductive primary test loop. At a time t1, the vehicle is traversing over a section of the route that is intact and does not have an electrical short, as shown in FIG. 9A.

At time t2, the vehicle traverses over an electrical short. As shown in FIG. 10, immediately after t2, the amplitude of the electrical signal 1012 indicative of the first examination signal received by the first detection unit 1002 increases by a significant gain, but the amplitude of the electrical signal 1014 indicative of the second examination signal received by the first detection unit 1002 decreases. As such, the electrical characteristics received at the first detection unit 1002 indicate a greater significance of the first examination signal (e.g., due to the first electrical signal circulating newly-defined loop 918 in FIG. 9B), while less significance of the second examination signal. At the second detection unit 1004 at time t2, the electrical signal 1016 indicative of the first examination signal decreases in like manner to the electrical signal 1016 received by the first detection unit 1002. The electrical signal 1018 indicative of the second examination signal increases in amplitude from time t2 to t4 (e.g., when the test loop passes the electrical short).

These electrical characteristics indicate that the electrical short defines new circuit loops within the primary test loop. The amplitude of the examination signals that were injected proximate to the respective detection units 1002, 1004 increase, while the amplitude of the examination signals that were injected on the other side of the test loop from the respective detection units 1002, 1004 decrease. For example the electrical signal 1012 increased right away due to the first electrical signal circulating newly-defined loop 918 in FIG. 9B. The electrical signal 1018 also increased due to the second electrical signal circulating the newly-defined loop 920. The positive slope of the electrical signal 1018 may be inverse from the negative slope of the electrical signal 1012. For example, the amplitude of the electrical signal 1012 monitored by the first detection device 1002 may be an inverse derivative of the amplitude of the electrical signal 1018 monitored by the second detection device 1004. This inverse relationship is due to the movement of the vehicle relative to the stationary electrical short along the route. Time t3 may represent the location of the electrical short relative to the test loop as shown in FIG. 9B.

At time t4, the test section (e.g., loop) of the vehicle passes beyond the electrical short. Between times t4 and t5, the electrical signals 1000 on the graph 1010 indicate that both the first and second examination signals once again circulate the primary test loop, as shown in FIG. 9A.

At time t5, the vehicle traverses over an electrical break in the route. As shown in FIG. 10, immediately after t5, the amplitude of each of the electrical signals 1012-1018 decrease by a significant step. Throughout the length of time for the test section to pass the electrical break in the route, represented as between times t5 and t7, all four signals 1012-1018 are at a low or at least attenuated amplitude, indicating that the first and second examination signals are not circulating the test loop due to the electrical break in the route. Time t6 may represent the location of the electrical break relative to the test loop as shown in FIG. 9C.

In an embodiment, the identification unit may be configured to use the received electrical signals 1000 to determine whether a section of the route traversed by the vehicle is potentially damaged, meaning that the section may be damaged or may include an electrical short that creates a false alarm. For example, based on the recorded waveforms of the electrical signals 1000 between times t2-t4 and t5-t7, the identification unit may identify the section of the route traversed between times t2-t4 as being non-damaged but having an electrical short and the section of route traversed between times t5-t7 as being damaged. For example, it is clear in the graph 1010 that the receiver coils or detection units 1002, 1004 both lose signal when the vehicle transits the damaged section of the route between times t5-t7. However, when crossing the short on the route between times t2-t4, the first detection unit 1002 loses the second examination signal, as shown on the electrical signal 1014, and the electrical signal 1018 representing second examination signal received by the second detection unit 1004 increases in amplitude as the short is transited. Thus, there is a noticeable distinction between a break in the track versus features that short the route. Optionally, a vehicle operator may view the graph 1010 on a display and manually identify sections of the route as being damaged or non-damaged but having an electrical short based on the recorded waveforms of the electrical signals 1000.

In an embodiment, the examining system may be further used to distinguish between non-damaged track features by the received electrical signals 1000. For example, wide band shunts (e.g., capacitors) may behave similar to hard wire highway crossing shunts, except an additional phase shift may be identified depending on the frequencies of the first and second examination signals. Narrow band (e.g., tuned) shunts may impact the electrical signals 1000 by exhibiting larger phase and amplitude differences responsive to the relation of the tuned shunt frequency and the frequencies of the examination signals.

The examining system may also distinguish electrical circuit breaks due to damage from electrical breaks (e.g., pseudo-breaks) due to intentional track features, such as insulated joints and turnouts (e.g., track switches). In turnouts, in specific areas, only a single pair of transmit and receive coils (e.g., a single application device and detection unit located along one conductive track) may be able to inject current (e.g., an examination signal). The pair on the opposite track (e.g., rail) may be traversing a "fouling circuit," where the opposite track is electrically connected at only one end, rather than part of the circulating current loop.

With regard to insulated joints, for example, distinguishing insulated joints from broken rails may be accomplished by an extended signal absence in the primary test loop caused by the addition of a dead section loop. As is known in the art, railroad standards typically indicate the required stagger of insulated joints to be 32 in. to 56 in. In addition to the insulated joint providing a pseudo-break with an extended length, detection may be enhanced by identifying location specific signatures of signaling equipment connected to the insulated joints, such as batteries, track relays, electronic track circuitry, and the like. The location specific signatures of the signaling equipment may be received in the monitored electrical characteristics in response to the current circulating the newly-defined short loops 918, 920 (shown in FIGS. 9A-9C) through the connected equipment. For example, signaling equipment that is typically found near an insulated joint may have a specific electrical signature or identifier, such as a frequency, modulation, embedded signature, and the like, that allows the examination system to identify the signaling equipment in the monitored electrical characteristics. Identifying signaling equipment typically found near an insulated joint provides an indication that the vehicle is traversing over an insulated joint in the route, and not a damaged section of the route.

Figure 11:
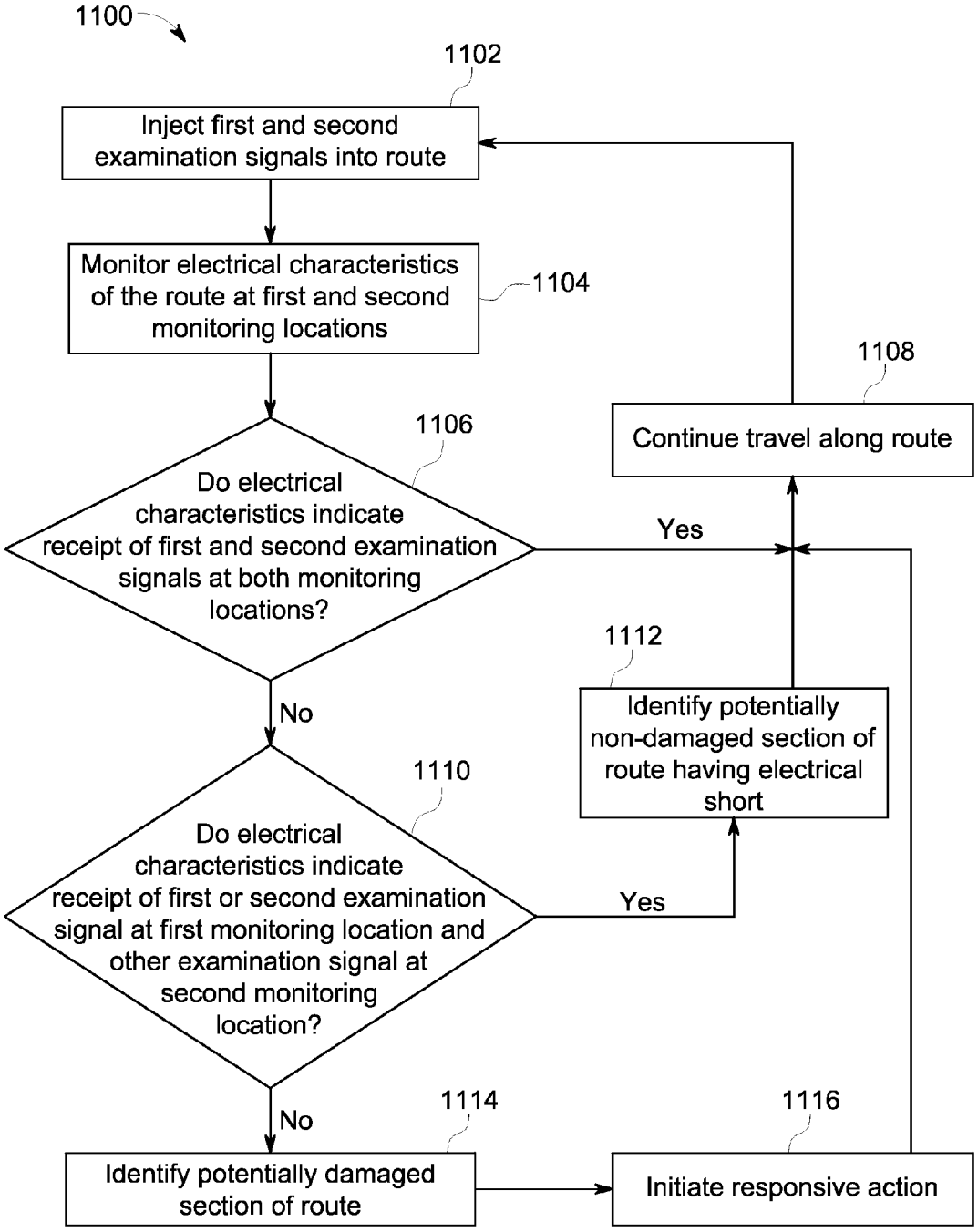
FIG. 11 is a flowchart of an embodiment of a method for examining a route being traveled by a vehicle system from onboard the vehicle system.

FIG. 11 is a flowchart of an embodiment of a method 1100 for examining a route being traveled by a vehicle system from onboard the vehicle system. The method 1100 may be used in conjunction with one or more embodiments of the vehicle systems and/or examining systems described herein. Alternatively, the method 1100 may be implemented with another system.

At 1102, first and second examination signals are electrically injected into conductive tracks of the route being traveled by the vehicle system. The first examination signal may be injected using a first vehicle of the vehicle system. The second examination signal may be injected using the first vehicle at a rearward or frontward location of the first vehicle relative to where the first examination signal is injected. Optionally, the first examination signal may be injected using the first vehicle, and the second examination signal may be injected using a second vehicle in the vehicle system. Electrically injecting the first and second examination signals into the conductive tracks may include applying a designated direct current, a designated alternating current, and/or a designated radio frequency signal to at least one conductive track of the route. The first and second examination signals may be transmitted into different conductive tracks, such as opposing parallel tracks.

At 1104, one or more electrical characteristics of the route are monitored at first and second monitoring locations. The monitoring locations may be onboard the first vehicle in response to the first and second examination signals being injected into the conductive tracks. The first monitoring location may be positioned closer to the front of the first vehicle relative to the second monitoring location. Detection units may be located at the first and second monitoring locations. Electrical characteristics of the route may be monitored along one conductive track at the first monitoring location; the electrical characteristics of the route may be monitored along a different conductive track at the second monitoring location. Optionally, a notification may be communicated to the first and second monitoring locations when the first and second examination signals are injected into the route. Monitoring the electrical characteristics of the route may be performed responsive to receiving the notification.

At 1106, a determination is made as to whether one or more monitored electrical characteristics indicate receipt of both the first and second examination signals at both monitoring locations. For example, if both examination signals are monitored in the electrical characteristics at both monitoring locations, then both examination signals are circulating the conductive test loop 912 (shown in FIGS. 9A-9C). As such, the circuit of the test loop is intact. But, if each of the monitoring locations monitors electrical characteristics indicating only one or none of the examination signals, then the circuit of the test loop may be affected by an electrical break or an electrical short. If the electrical characteristics do indicate receipt of both first and second examination signals at both monitoring locations, flow of the method 1100 may proceed to 1108.

At 1108, the vehicle continues to travel along the route. Flow of the method 1100 then proceeds back to 1102 where the first and second examination signals are once again injected into the conductive tracks, and the method 1100 repeats. The method 1100 may be repeated instantaneously upon proceeding to 1108, or there may be a wait period, such as 1 second, 2 seconds, or 5 seconds, before re-injecting the examination signals.

Referring back to 1106, if the electrical characteristics indicate that both examination signals are not received at both monitoring locations, then flow of the method 1100 proceeds to 1110. At 1110, a determination is made as to whether one or more monitored electrical characteristics indicate a presence of only the first or the second examination signal at the first monitoring location and a presence of only the other examination signal at the second monitoring location. For example, the electrical characteristics received at the first monitoring location may indicate a presence of only the first examination signal, and not the second examination signal. Likewise, the electrical characteristics received at the second monitoring location may indicate a presence of only the second examination signal, and not the first examination signal. As described herein, "indicat[ing] a presence of" an examination signal means that the received electrical characteristics include more than a mere threshold signal-to-noise ratio of the unique identifier indicative of the respective examination signal that is more than electrical noise.

This determination may be used to distinguish between electrical characteristics that indicate the section of the route is damaged and electrical characteristics that indicate the section of the route is not damaged but may have an electrical short. For example, since the first and second examination signals are not both received at each of the monitoring locations, the route may be identified as being potentially damaged due to a broken track that is causing an open circuit. However, an electrical short may also cause one or both monitoring locations to not receive both examination signals, potentially resulting in a false alarm. Therefore, this determination is made to distinguish an electrical short from an electrical break.

For example, if neither examination signal is received at either of the monitoring locations as the vehicle system traverses over the section of the route, the electrical characteristics may indicate that the section of the route is damaged (e.g., broken). Alternatively, the section may be not damaged but including an electrical short if the one or more electrical characteristics monitored at one of the monitoring locations indicate a presence of only one of the examination signals. This indication may be strengthened if the electrical characteristics monitored at the other monitoring location indicate a presence of only the other examination signal. Additionally, a non-damaged section of the route having an electrical short may also be indicated if an amplitude of the electrical characteristics monitored at the first monitoring location is an inverse derivative of an amplitude of the electrical characteristics monitored at the second monitoring location as the vehicle system traverses over the section of the route. If the monitored electrical characteristics indicate significant receipt of only one examination signal at the first monitoring location and only the other examination signal at the second monitoring location, then flow of the method 1100 proceeds to 1112.

At 1112, the section of the route is identified as being non-damaged but having an electrical short. In response, the notification of the identified section of the route including an electrical short may be communicated off-board and/or stored in a database onboard the vehicle system. The location of the electrical short may be determined more precisely by comparing a location of the vehicle over time to the inverse derivatives of the monitored amplitudes of the electrical characteristics monitored at the monitoring locations. For example, the electrical short may have been equidistant from the two monitoring locations when the inverse derivatives of the amplitude are monitored as being equal. Location information may be obtained from a location determining unit, such as a GPS device, located on or off-board the vehicle. After identifying the section as having an electrical short, the vehicle system continues to travel along the route at 1108.

Referring now back to 1100, if the monitored electrical characteristics do not indicate significant receipt of only one examination signal at the first monitoring location and only the other examination signal at the second monitoring location, then flow of the method 1100 proceeds to 1114. At 1114, the section of the route is identified as damaged. Since neither monitoring location receives electrical characteristics indicating at least one of the examination signals, it is likely that the vehicle is traversing over an electrical break in the route, which prevents most if not all of the conduction of the examination signals along the test loop. The damaged section of the route may be disposed between the designated axles of the first vehicle that define ends of the test loop based on the one or more electrical characteristics monitored at the first and second monitoring locations. After identifying the section of the route as being damaged, flow proceeds to 1116.

At 1116, responsive action is initiated in response to identifying that the section of the route is damaged. For example, the vehicle, such as through the control unit and/or identification unit, may be configured to automatically slow movement, automatically notify one or more other vehicle systems of the damaged section of the route, and/or automatically request inspection and/or repair of the damaged section of the route. A warning signal may be communicated to an off-board location that is configured to notify a recipient of the damaged section of the route. A repair signal to request repair of the damaged section of the route may be communicated off-board as well. The warning and/or repair signals may be communicated by at least one of the control unit or the identification unit located onboard the vehicle. Furthermore, the responsive action may include determining a location of the damaged section of the route by obtaining location information of the vehicle from a location determining unit during the time that the first and second examination signals are injected into the route. The calculated location of the electrical break in the route may be communicated to the off-board location as part of the warning and/or repair signal. Optionally, responsive actions, such as sending warning signals, repair signals, and/or changing operational settings of the vehicle, may be at least initiated manually by a vehicle operator onboard the vehicle or a dispatcher located at an off-board facility.

Figure 14:
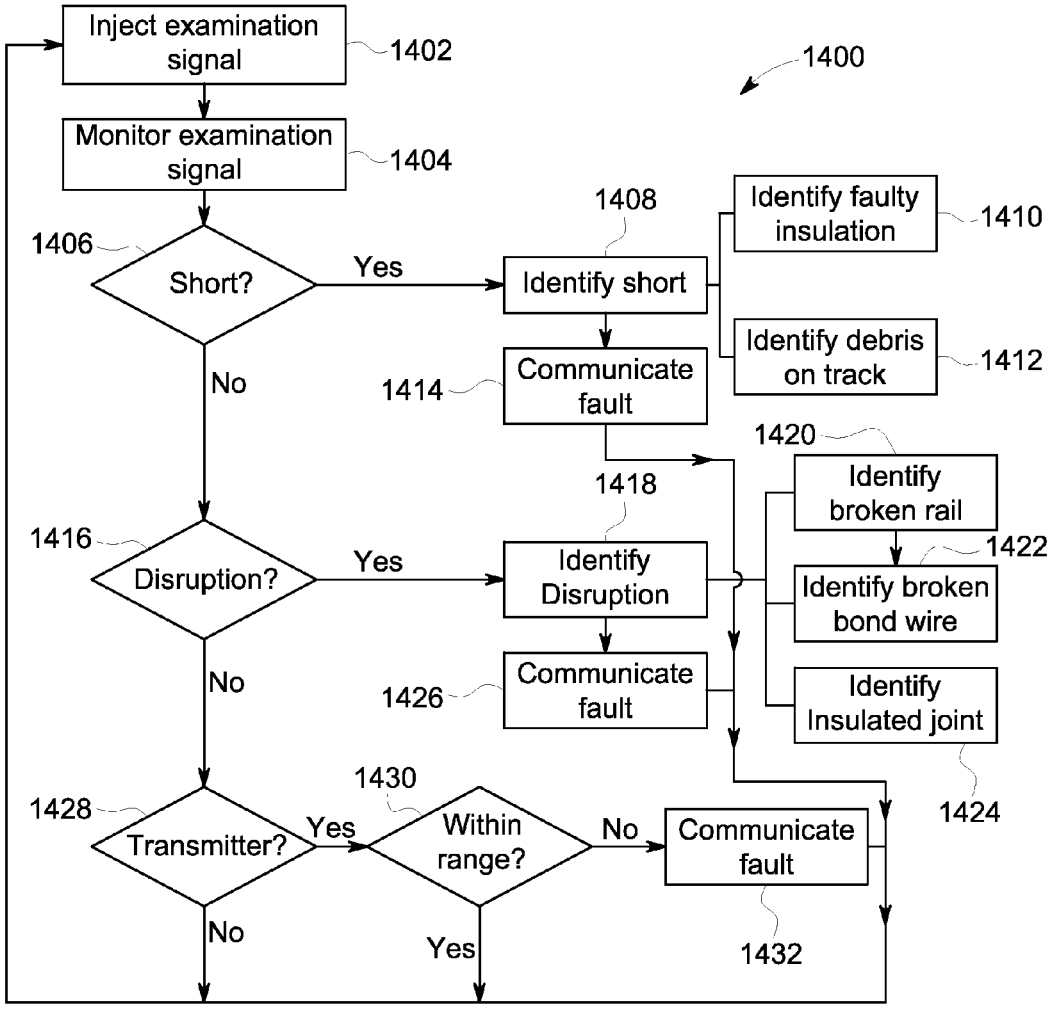
FIG. 14 is a flowchart of an embodiment of a method for examining route being traveled by a vehicle system in accordance with an embodiment.

FIG. 14 illustrates a flowchart of a method 1400 for examining a route in accordance with one example of the present inventive subject matter. The method 1400 may be performed, for example, using certain components, equipment, structures, steps, or other aspects of embodiments discussed above. In certain embodiments, certain steps may be added or omitted, certain steps may be performed simultaneously or concurrently with other steps, certain steps may be performed in different order, and certain steps may be performed more than once, for example, in an iterative fashion. In various embodiments, portions, aspects, and/or variations of the method may be able to be used as one or more algorithms to direct hardware (e.g., one or more aspects of the processing unit 219) to perform operations described herein.

At 1402, first and second examination signals are injected into a route (e.g., first and second conductive tracks of a route). The examination signals may be injected at spaced apart locations along a length of a vehicle traversing the route. The examination signals may be injected conductively and/or inductively.

At 1404, the examination signals are monitored. The examination signals may be detected, for example, using one or more detection units disposed onboard the vehicle. The examination signals may be detected or monitored generally continuously, and/or at predetermined intervals, and/or over predetermined ranges. For example, examination signals to be monitored for determining faults in signaled territory may be monitored when the vehicle is within signaled territory (or near to signaled territory), but not when the vehicle is out of signaled territory. It may be noted that, in various embodiments, as discussed herein, signals resulting from transmission from an off-board source may be monitored and analyzed additionally or alternatively.

At 1406, it is determined if a monitored examination signal corresponds to a short. If the signal corresponds to a short, the type of short may be identified at 1408. For example, at 1410, faulty insulation may be identified as the cause of the short based on a signature of the signal, and/or based on the fault corresponding to the known location of a switch having insulated components. As another example, at 1412, debris (e.g., metal banding) may be identified as the cause of the short if the fault occurs at a location that does not correspond to a known location of a switch or other device having insulated components. At 1414, the type of fault and location of the fault are communicated to an off-board entity. The off-board entity may then repair or schedule repair of the fault.

At 1416, it is determined if the monitored examination signal corresponds to a disruption in transmission of the examination signal. If the signal corresponds to a disruption, the type of disruption may be identified at 1418. For example, at 1420, a broken rail may be identified as a cause of the fault, for example based on a signature of the signal, or, additionally or alternatively, based on a location of the fault (e.g., the fault occurring at a location not corresponding to a known location of an insulated joint). As another example, at 1422, a broken bond wire may be identified as a cause of the fault, for example, based on a signature. In some embodiments, a broken bond wire may be identified based upon a noise characteristic of the signal. As another example, at 1424, an insulated joint may be identified as a cause of the disruption, for example based on a signature and/or location of the disruption of the signal as discussed herein. In some embodiments, if both members of an insulated joint pair are identified as causing disruptions, the signal may not be identified as corresponding to a fault, but if only a single member of the pair is identified as functioning properly, the signal may be identified as corresponding to a fault. At 1426, the type of fault and location of the fault are communicated to an off-board entity.

At 1428, it is determined if a monitored or detected signal corresponds to an off-board transmitter configured to transmit a signal through the track. If the signal is from an off-board transmitter, for example, at 1430, the monitored or detected signal may be compared to a calibrated signal for a properly operating transmitter. If the monitored or detected signal is within an acceptable range of the calibrated signal, no fault may be detected. If the monitored or detected signal is not within the acceptable range, a fault may be identified and communicated to an off-board entity at 1432. In some embodiments, if the monitored or detected signal is not within an acceptable operating range, the fault may be communicated as a current fault; however, if the monitored or detected signal is within an acceptable operating range but not within a desired operating range and/or near to an unacceptable range, a future or expected fault of the transmitter may be communicated to the off-board entity.

The injection of examination signals, monitoring of examination signals, and identification of faults may be performed iteratively or continuously as the vehicle traverses a route during performance of a mission. It may be noted that additional or alternative faults may be identified in various embodiments. For example, if a signal characteristic, shape, or signature is not observed at an expected location (e.g., an expected location of a transmitter or an expected location of an insulated joint, among others), a component or attribute associated with the expected signal characteristic, shape, or signature at the expected location may be identified as having a fault or potential fault.

In an embodiment, a system includes first and second application devices, a control unit, and at least one processor. The first and second application devices are configured to be disposed onboard a vehicle system having at least one vehicle and configured to travel along a route having first and second conductive tracks, with the first and second application devices each configured to be at least one of conductively or inductively coupled with one of the conductive tracks. The control unit is configured to control supply of electric current from a power source to the first and second application devices in order to electrically inject a first examination signal into the conductive tracks via the first application device and to electrically inject a second examination signal into the conductive tracks via the second application device. The at least one processor is configured to be disposed onboard the vehicle system, and to be operably coupled with first and second detection devices disposed onboard the vehicle system. The first and second detection devices are configured to detect the injected examination signals. The at least one processor is configured to monitor one or more electrical characteristics of the first and second conductive tracks in response to the first and second examination signals being injected into the conductive tracks, and to identify a type of fault based upon the one or more electrical characteristics of the first and second conductive tracks.

In one aspect, the at least one processor is configured to distinguish between different types of short circuits based upon at least one of a location or a signature corresponding to the one or more electrical characteristics.

In one aspect, the at least one processor is configured to distinguish, for a detected short, between failed insulation and a short on the route based upon a location of the detected short.

In one aspect, the at least one processor is configured to distinguish, for a detected fault, between a broken rail and a failed one of a pair of insulation joints based upon a location of the detected fault.

In one aspect, the at least one processor is configured to distinguish, for a detected fault, between a broken bond wire and a broken rail based upon a noise characteristic of the one or more electrical characteristics.

In one aspect, the at least one processor is configured to monitor transmission of a signal from an off-board transmitter operably coupled to the route, and wherein the at least one processor is configured to identify a fault associated with the transmitter based on the monitored signal from the off-board transmitter.

In one aspect, the at least one processor is configured to identify the fault based on a comparison between the monitored signal and an expected signal corresponding to a properly functioning off-board transmitter.

In one aspect, the at least one processor is configured to identify an expected future fault based on an observed trend in acquired signals corresponding to the off-board transmitter over time, the acquired signals including the monitored signal, and to communicate a maintenance message to an off-board entity identifying the expected future fault.

In one aspect, the at least one processor is configured to communicate the type of the fault and a location of the fault to an off-board entity.

In one aspect, the at least one processor is configured to select the off-board entity to which the type of the fault and the location of the fault are communicated from a plurality of off-board entities based on the type of fault.

In an embodiment, a method includes electrically injecting, via first and second application devices, first and second examination signals into first and second conductive tracks of a route being traveled by a vehicle system having at least one vehicle, with the first and second examination signals being injected at spaced apart locations along a length of the vehicle system. The method also includes monitoring, via first and second detection devices, one or more electrical characteristics of the first and second conductive tracks at first and second monitoring locations that are onboard the vehicle system in response to the first and second examination signals being injected into the conductive tracks, with the first monitoring location spaced apart along the length of the vehicle relative to the second monitoring location. Also, the method includes identifying a type of fault along the route based upon the one or more electrical characteristics monitored at the first and second monitoring locations.

In one aspect, identifying the type of fault includes distinguishing between different types of short circuits.

In one aspect, distinguishing between different types of short circuits includes distinguishing, for a detected short, between failed insulation and a short on the route, based upon a location of the detected short.

In one aspect, identifying the type of fault includes distinguishing, for a detected fault, between a broken rail and a failed one of a pair of insulation joints, based upon a location of the detected fault.

In one aspect, identifying the type of fault includes distinguishing, for a detected fault, between a broken bond wire and a broken rail based upon a noise characteristic of the one or more electrical characteristics.

In one aspect, the method further includes monitoring, via at least one of the first or second detection devices, transmission of a signal from an off-board transmitter operably coupled to the route, and identifying a fault associated with the transmitter based on the monitored signal from the off-board transmitter.

In one aspect, identifying the fault associated with the transmitter includes identifying the fault based on a comparison between the monitored signal and an expected signal corresponding to a properly functioning transmitter.

In one aspect, identifying the fault associated with the transmitter comprises identifying an expected future fault based on an observed trend in acquired signals corresponding to the off-board transmitter over time, with the acquired signals including the monitored signal, and communicating a maintenance message to an off-board entity identifying the expected future fault.

In one aspect, the method further includes communicating the type of fault and a location of the fault to an off-board entity.

In one aspect, the method further includes selecting the off-board entity to which the type of the fault and the location of the fault are communicated from a plurality of off-board entities based on the type of fault.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the inventive subject matter and also to enable a person of ordinary skill in the art to practice the embodiments of the inventive subject matter, including making and using any devices or systems and performing any incorporated methods. The patentable scope of the inventive subject matter may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "an embodiment" or "one embodiment" of the inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described systems and methods without departing from the spirit and scope of the inventive subject matter herein involved, it is intended that all of the subject matter of the above description or shown in the accompanying drawings shall be interpreted merely as examples illustrating the inventive concept herein and shall not be construed as limiting the inventive subject matter.

The invention claimed is:

1. A system comprising: first and second application devices configured to be disposed onboard a vehicle system having at least one vehicle and configured to travel along a route having first and second conductive tracks, the first and second application devices each configured to be at least one of conductively or inductively coupled with one of the conductive tracks; and at least one processor configured to be disposed onboard the vehicle system, the at least one processor operably coupled with first and second detection devices disposed onboard the vehicle system, the first and second detection devices configured to detect the injected examination signals, the at least one processor configured to: control supply of electric current from a power source to the first and second application devices in order to electrically inject a first examination signal into the conductive tracks via the first application device and to electrically inject a second examination signal into the conductive tracks via the second application device; monitor one or more electrical characteristics of the first and second conductive tracks in response to the first and second examination signals being injected into the conductive tracks; identify a classification, from plural classifications, of fault based upon the one or more electrical characteristics of the first and second conductive tracks; and initiate a responsive action to control the vehicle system in response to identifying the classification of fault; wherein the at least one processor is configured to, if the one or more electrical characteristics comprise one or more signal characteristics that correspond to a potential insulated joint or a potential broken rail, determine that the one or more signal characteristics are due to insulated joints if the one or more signal characteristics occur on both of the first and second conductive tracks.

2. The system of claim 1, wherein the at least one processor is configured to: if the one or more signal characteristics are observed on only one of the first or second conductive tracks, and a location of the one or more signal characteristics corresponds to a known location of insulated joints, determine that the one or more signal characteristics are due to one faulty insulated joint and one not faulty insulated joint: and if the one or more signal characteristics are observed on only one of the first or second conductive tracks, and the location of the one or more signal characteristics does not correspond to a known location of insulated joints, determine that the one or more signal characteristics are due to a broken rail.

3. The system of claim 1, wherein the at least one processor is configured to distinguish, for a detected short, between failed insulation and metal on one of the first or second conductive tracks, wherein the at least one processor is configured to determine that a detected short is due to failed insulation when a location of the detected short corresponds to a location of a switch.

4. The system of claim 1, wherein the at least one processor is configured to distinguish, for a detected fault, between a broken bond wire and a broken rail based upon a noise characteristic of the one or more electrical characteristics.

5. The system of claim 1, wherein the at least one processor is configured to monitor transmission of a signal from an off-board transmitter operably coupled to the route, and wherein the at least one processor is configured to identify a fault of the transmitter based on the monitored signal from the off-board transmitter.

6. The system of claim 5, wherein the at least one processor is configured to identify the fault based on a comparison between the monitored signal and an expected signal corresponding to a properly functioning off-board transmitter.

7. The system of claim 5, wherein the at least one processor is configured to identify an expected future fault of the transmitter based on an observed trend in acquired signals corresponding to the off-board transmitter over time, the acquired signals including the monitored signal, and to communicate a maintenance message to an off-board entity identifying the expected future fault.

8. The system of claim 1, wherein the at least one processor is configured to communicate the classification of fault and a location of the fault to an off-board entity.

9. The system of claim 8, wherein the at least one processor is configured to select the off-board entity to which the classification of fault and the location of the fault are communicated from a plurality of off-board entities based on the classification of fault.

10. A method comprising: electrically injecting, via first and second application devices, first and second examination signals into first and second conductive tracks of a route being traveled by a vehicle system having at least one vehicle, the first and second examination signals being injected at spaced apart locations along a length of the vehicle system; monitoring, via first and second detection devices, one or more electrical characteristics of the first and second conductive tracks at first and second monitoring locations that are onboard the vehicle system in response to the first and second examination signals being injected into the conductive tracks, the first monitoring location spaced apart along the length of the vehicle system relative to the second monitoring location; identifying a classification, from plural classifications, of fault for a fault along the route based upon the one or more electrical characteristics monitored at the first and second monitoring locations; and initiating a responsive action to control the vehicle system in response to identifying the classification of fault; further comprising, if the one or more electrical characteristics comprise one or more signal characteristics that correspond to a potential insulated joint or a potential broken rail, determining that the one or more signal characteristics are due to insulated joints if the one or more signal characteristics occur on both of the first and second conductive tracks.

11. The method of claim 10, further comprising: determining that the one or more signal characteristics are due to one faulty insulated joint and one not faulty insulated joint if the one or more signal characteristics are observed on only one of the first or second conductive tracks, and a location of the one or more signal characteristics corresponds to a known location of insulated joints; and determining that the one or more signal characteristics are due to a broken rail if the one or more signal characteristics are observed on only one of the first or second conductive tracks, and the location of the one or more signal characteristics does not correspond to a known location of insulated joints.

12. The method of claim 10, wherein identifying the classification of fault comprises distinguishing, for a detected short, between failed insulation and metal on one of the first or second conductive tracks, wherein the detected short is determined to be due to failed insulation when a location of the detected short corresponds to a location of a switch.

13. The method of claim 10, wherein identifying the classification of fault comprises distinguishing, for a detected fault, between a broken bond wire and a broken rail based upon a noise characteristic of the one or more electrical characteristics.

14. The method of claim 10, further comprising:

monitoring, via at least one of the first or second detection devices, transmission of a signal from an off-board transmitter operably coupled to the route; and identifying a fault of the transmitter based on the monitored signal from the off-board transmitter.

15. The method of claim 14, wherein identifying the fault associated with the transmitter comprises identifying the fault based on a comparison between the monitored signal and an expected signal corresponding to a properly functioning transmitter.

16. The method of claim 14, wherein identifying the fault associated with the transmitter comprises identifying an expected future fault of the transmitter based on an observed trend in acquired signals corresponding to the off-board transmitter over time, the acquired signals including the monitored signal, and communicating a maintenance message to an off-board entity identifying the expected future fault.

17. The method of claim 10, further comprising communicating the classification of fault and a location of the fault to an off-board entity.

18. The method of claim 17, further comprising selecting the off-board entity to which the classification of fault and the location of the fault are communicated from a plurality of off-board entities based on the classification of fault.

* * * * *